US010081194B2

(12) United States Patent
Burdge et al.

(10) Patent No.: US 10,081,194 B2
(45) Date of Patent: Sep. 25, 2018

(54) MECHANICAL LOCK-OUT MECHANISM FOR MOTOR LATCH COUPLER

(71) Applicant: Colder Products Company, St. Paul, MN (US)

(72) Inventors: David Alan Burdge, Minneapolis, MN (US); William J. Rankin, Burnsville, MN (US)

(73) Assignee: Colder Products Company, St. Paul, MN (US)

( * ) Notice: Subject to any disclaimer, the term of this patent is extended or adjusted under 35 U.S.C. 154(b) by 483 days.

(21) Appl. No.: 14/826,365

(22) Filed: Aug. 14, 2015

(65) Prior Publication Data

US 2016/0046130 A1 Feb. 18, 2016

Related U.S. Application Data

(60) Provisional application No. 62/037,395, filed on Aug. 14, 2014.

(51) Int. Cl.
*B41J 2/175* (2006.01)

(52) U.S. Cl.
CPC ..... *B41J 2/17543* (2013.01); *B41J 2/175* (2013.01); *B41J 2/1752* (2013.01); *B41J 2/17523* (2013.01); *Y10T 403/14* (2015.01); *Y10T 403/1624* (2015.01); *Y10T 403/593* (2015.01)

(58) Field of Classification Search
CPC ..... B41J 2/175; B41J 2/1752; B41J 2/17526; B41J 2/17543; B41J 2/17546; B41J 2/1755; B41J 2/17523; F16C 11/10; Y10T 403/14; Y10T 403/148; Y10T 403/1616; Y10T 403/1624; Y10T 403/591; Y10T 403/593; Y10T 403/599; Y10T 403/60; Y10T 403/602
USPC ..... 403/6, 9, 13, 14, 322.1, 322.3, 325–327
See application file for complete search history.

(56) References Cited

U.S. PATENT DOCUMENTS

| | | | | |
|---|---|---|---|---|
| 1,422,461 | A * | 7/1922 | Marks | G03B 9/08 396/510 |
| 5,033,777 | A | 7/1991 | Blenkush | |
| 6,354,540 | B1 | 3/2002 | Lewis et al. | |
| 6,649,829 | B2 | 11/2003 | Garber et al. | |
| 7,543,779 | B1 | 6/2009 | Lewis et al. | |
| 7,883,197 | B2 * | 2/2011 | Mantell | B41J 2/17593 347/88 |

(Continued)

FOREIGN PATENT DOCUMENTS

| | | | |
|---|---|---|---|
| EP | 1671568 | A2 | 6/2006 |
| EP | 2216785 | A1 | 8/2010 |

(Continued)

OTHER PUBLICATIONS

International Search Report and Written Opinion in PCT/US2015/045341 dated Oct. 22, 2015, 13 pages.

*Primary Examiner* — Josh Skroupa
(74) *Attorney, Agent, or Firm* — Fish & Richardson P.C.

(57) ABSTRACT

A motorized coupler assembly includes a coupler for coupling an insert to a receiving device; a plurality of movable components that cover an opening of the coupler; an electric motor; and an electronic sensing device. When the electronic sensing device detects an insert of a correct type, the movable components rotate to uncover the opening of the coupler and permit the insert to come into contact with the coupler.

20 Claims, 24 Drawing Sheets

(56) References Cited

U.S. PATENT DOCUMENTS

| | | | | |
|---|---|---|---|---|
| 8,061,825 | B2 * | 11/2011 | Umeda | B41J 2/17513 347/84 |
| 8,215,754 | B2 * | 7/2012 | Akiyama | B41J 2/17513 347/19 |
| 9,067,424 | B1 * | 6/2015 | Tominaga | B41J 2/17523 |
| 2004/0001126 | A1 | 1/2004 | Oda et al. | |
| 2007/0063914 | A1 | 3/2007 | Becker | |
| 2008/0003140 | A1 | 1/2008 | Di et al. | |
| 2009/0039002 | A1 | 2/2009 | Umeda | |
| 2009/0213196 | A1 | 8/2009 | Mantell et al. | |
| 2012/0168305 | A1 | 7/2012 | Hunter | |
| 2015/0075121 | A1 * | 3/2015 | Leitner | F02M 35/082 55/309 |
| 2015/0135502 | A1 | 5/2015 | Rankin | |

FOREIGN PATENT DOCUMENTS

| | | | |
|---|---|---|---|
| GB | 2082509 | A | 3/1982 |
| WO | 2012/012779 | A2 | 1/2012 |

* cited by examiner

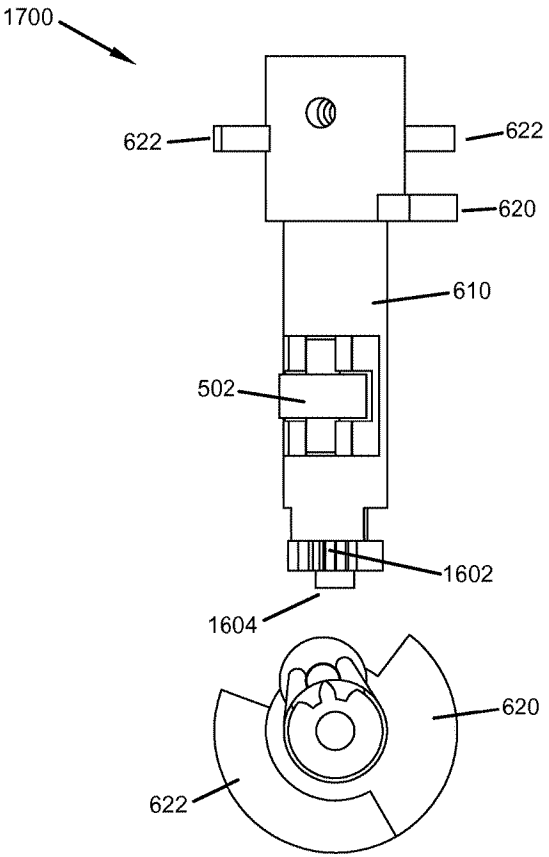
FIG. 17A
FIG. 17B
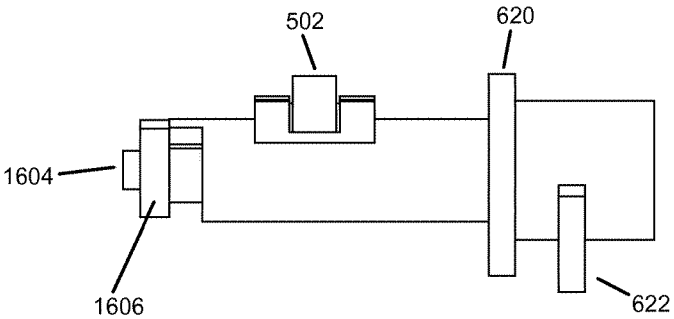
FIG. 17C

MECHANICAL LOCK-OUT MECHANISM FOR MOTOR LATCH COUPLER

BACKGROUND

A coupler is typically used to connect a component to a receiving device, for example to connect an ink cartridge to a printer. When the component is connected to the receiving device, a material in the component comes in contact with a material in the receiving device. When an incorrect component is connected to the receiving device, the materials in both the component and the receiving device may become contaminated.

One or more mechanical methods may be used to attempt to prevent an incorrect component from being connected to a receiving device. In one method, the component and receiving device may be keyed, so that only a specific type of component may be connected to a receiving device. In another method, components and receiving devices may be fabricated of different sizes and shapes so that only a specific size and shape of component may be connected to the receiving device. In a third method, the component may include an electronic tag, such as a radio frequency identification (RFID) tag. Using the third method, a connection is permitted only when the RFID tag is identified as a correct tag by a RFID reader in the receiving device.

Limitations may be associated with each of these methods. The mechanical methods typically increase a company's costs because of the plurality of components, for example cartridges, that may be required and because of an overhead associated with managing the components. The electronic method may provide an indication that an incorrect component is being used; however the electronic method does not prevent the incorrect component from being inserted into the receiving device.

SUMMARY

According to one aspect, a motorized coupler assembly comprises: a coupler for coupling an insert to a receiving device; a plurality of movable components that cover an opening of the coupler; an electric motor; and an electronic sensing device, wherein, when the electronic sensing device detects an insert of a correct type, the movable components rotate to uncover the opening of the coupler and permit the insert to come into contact with the coupler.

According to another aspect, a method for connecting an insert of a component to a motorized coupler assembly comprises: detecting the insert at the motorized coupler assembly; determining whether the insert is of a correct type for a latch coupler; when a determination is made that the insert is the correct type for the latch coupler, moving a movable iris on the motorized coupler assembly into an open position to allow insertion of at least a portion of the insert into the motorized coupler assembly; and when a determination is made that the insert is not the correct type for the latch coupler, maintaining the movable iris in a closed position to prevent the insertion of the insert into the motorized coupler assembly.

In yet another aspect, a motorized coupler assembly comprises: a coupler for coupling an insert to a receiving device; a movable iris that covers an opening of the coupler, the movable iris comprising a plurality of blade components, each blade component including at one end gear teeth and at a second end a curved shape that may cover a portion of the opening of the coupler; an electric motor; a ring gear attached to a shaft of the motor, the ring gear including gear teeth receptacles for receiving the gear teeth from each of the blade components; an eccentric bearing attached to the shaft of the motor, the eccentric bearing being rotated when the shaft of the motor rotates; a plurality of optical sensing devices, each optical sensing device including an optical emitter and an optical receiver; two vanes oriented offset from each other that are attached to the shaft of the motor; and a radio frequency identification (RFID) antenna, wherein, when the RFID sensing device senses an insert of a correct type, the shaft of the motor rotates to open the movable iris and permit the insert to come into contact with the coupler.

DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

FIG. 17A is a top view of the cam shaft assembly of FIG. 16.

FIG. 17B is a front view of the cam shaft assembly of FIG. 16.

FIG. 17C is a side view of the cam shaft assembly of FIG. 16.

DETAILED DESCRIPTION

Figure 1:
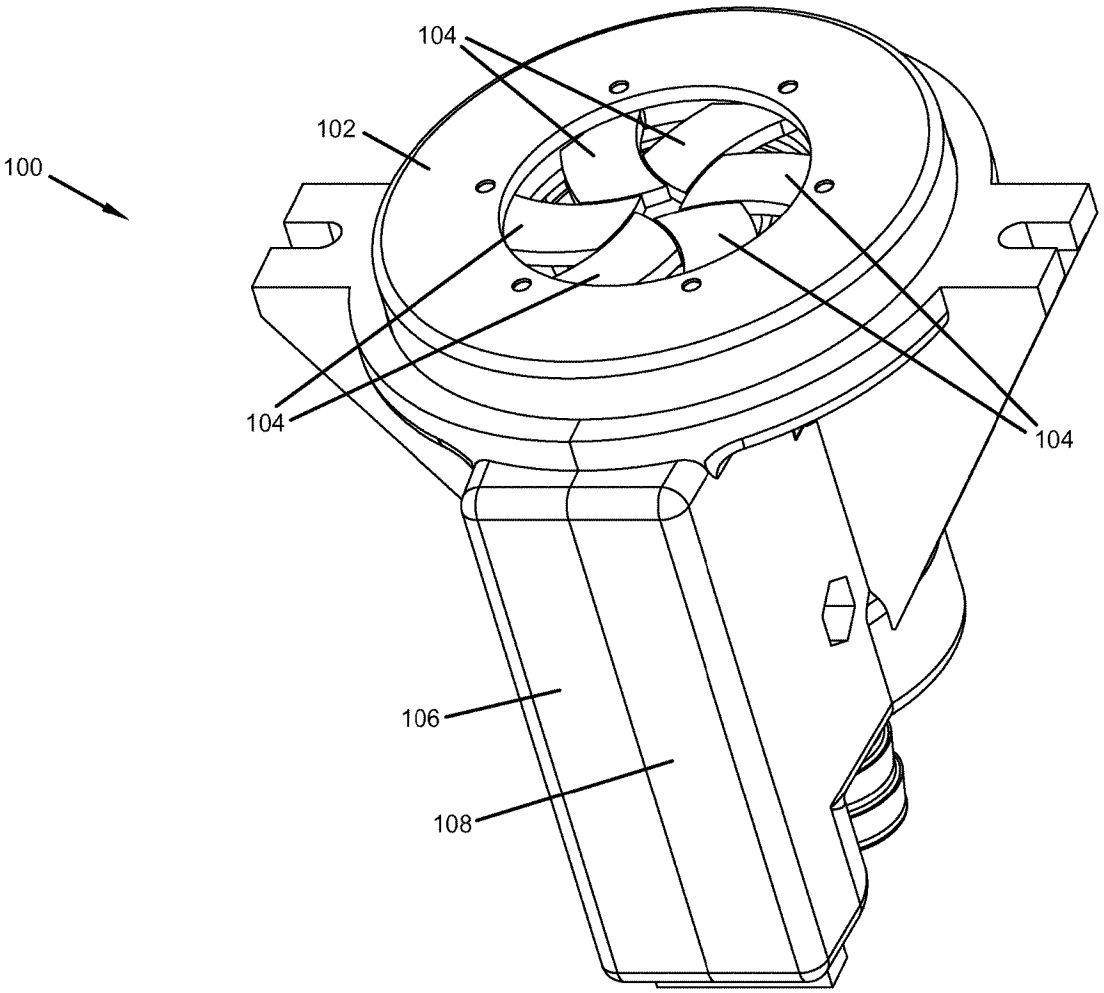
FIG. 1 is a perspective view of a lock-out coupler.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

The systems and methods of the present disclosure are directed to a fluid coupler with one or more lock-out mechanisms, referred to herein as lock-out couplers. In one example, a lock-out coupler comprises a motorized latch coupler and a lock-out mechanism for the motorized latch coupler. The lock-out mechanism comprises a movable iris that opens or closes an opening of the lock-out coupler. The movable iris includes a plurality of moveable blade components that rotate in a clockwise or counterclockwise direction under control of a motor. In an example embodiment, when the blade components rotate in a clockwise direction, the blade components move away from each other, creating an opening in the lock-out coupler so that the coupler can be connected to a mating coupler. When the blade components rotate in a counterclockwise direction, the blade components move towards each other, closing the opening of the lock-out coupler so that the coupler cannot be coupled to a mating insert.

The lock-out mechanism permits an insert of a correct component to be inserted into the motorized latch coupler and prevents an insert of an incorrect component from being inserted into the motorized latch coupler. As used in this disclosure, an insert is an elongated portion of a component such as a cartridge. The cartridge contains a liquid material, for example a colored ink that may be connected through the motorized latch coupler to a receiving device such as a printer. As used in this disclosure, a correct component is one, such as a cartridge, that is of a type compatible with the receiving device. An incorrect component is one that is an incorrect match for the receiving device.

In an example embodiment, when an insert of a component is moved to a close vicinity of the lock-out coupler, a determination is made as to whether the insert is a correct match for the motorized latch coupler. When a determination is made that the insert is a correct match, the movable iris opens and the insert is moved through an opening of the lock-out coupler to the motorized latch coupler. Conversely, when a determination is made that the insert is not a correct match, the movable iris does not open, preventing the insert from being inserted into the lock-out coupler.

The determination as to whether the insert is a correct match for the motorized latch coupler can be made via a wireless technology, such as radio frequency identification (RFID). In an example embodiment, each insert includes an RFID tag. In addition, in this embodiment the lock-out coupler includes an electronic sensing device. In this embodiment, the electronic sensing device is an RFID antenna, although other electronic sensing devices may be used. The RFID antenna is connected to an RFID reader device. The RFID reader device reads a serial number for a component, for example a cartridge, to which the insert is attached. When a determination is made that the component identified by the serial number is of a correct type for the receiving device, a determination is made that the insert is a correct match for the motorized latch coupler. Combining RFID identification with a mechanical lock-out mechanism, permits all inserts to be of the same size and shape, thereby saving money and overhead.

As an aid to an operator, the example lock-out coupler also includes a plurality of light emitting diodes (LEDs) that provide a visible status of the lock-out coupler. Both red and green LEDs are provided. Light from these LEDs is visible from the front of the lock-out coupler. Initially, when an insert is not in close vicinity to the lock-out coupler, the green LEDs flash, indicating that the lock-out coupler is ready to receive an insert. When an insert is brought into close vicinity of the lock-out coupler and a determination is made that the insert is of a correct type, the green LEDs change from flashing to steady illumination. However, when a determination is made that the insert is not of the correct type, the red LEDs illuminate.

In a typical embodiment, the lock-out coupler is connected to an electronic control panel. The control panel may comprise a touch screen or other similar device. The connection may be a wired or wireless connection. Typically, the movable iris opens automatically when a correct insert is in close vicinity of the lock-out coupler. This permits the insert to be inserted into the motorized latch coupler. When the insert is to be removed from the motorized latch coupler, an operator uses the touch screen to initiate a command to eject the insert from the motorized latch coupler. After the insert is ejected, the red LEDs flash, providing a warning to the operator that the movable iris is about to close.

Referring to FIGS. 1-6, an example lock-out coupler 100 is shown. The lock-out coupler 100 is enclosed by two plastic clam shells 106, 108. The plastic clam shell enclosure houses the motorized latch coupler and other components.

The lock-out coupler 100 includes a front cover 102, vanes 104 and a coupler body 302. Vanes 104 comprise a moveable iris that opens to permit insertion of an insert. The coupler body 302 includes a hose barb 304 that can be connected to a receiving device (e.g., threaded onto a receiving device like a printer). The lock-out coupler 100 also includes a RFID antenna/LED board 608, vanes 104, a ring gear 604, a gear motor 612, a cam shaft 610, an eccentric bearing 502, an electronics board 614, two optical interrupters 616, 618 and two vanes 620, 622 oriented offset from each other on the cam shaft 610.

When an insert to be inserted is moved to a close vicinity of the lock-out coupler 100 and a determination is made via RFID that the insert may be inserted in the lock-out coupler 100, gear motor 612 is activated causing cam shaft 610 to rotate. As discussed in more detail later herein, when cam shaft 610 rotates, ring gear 604 also rotates.

Figure 6:
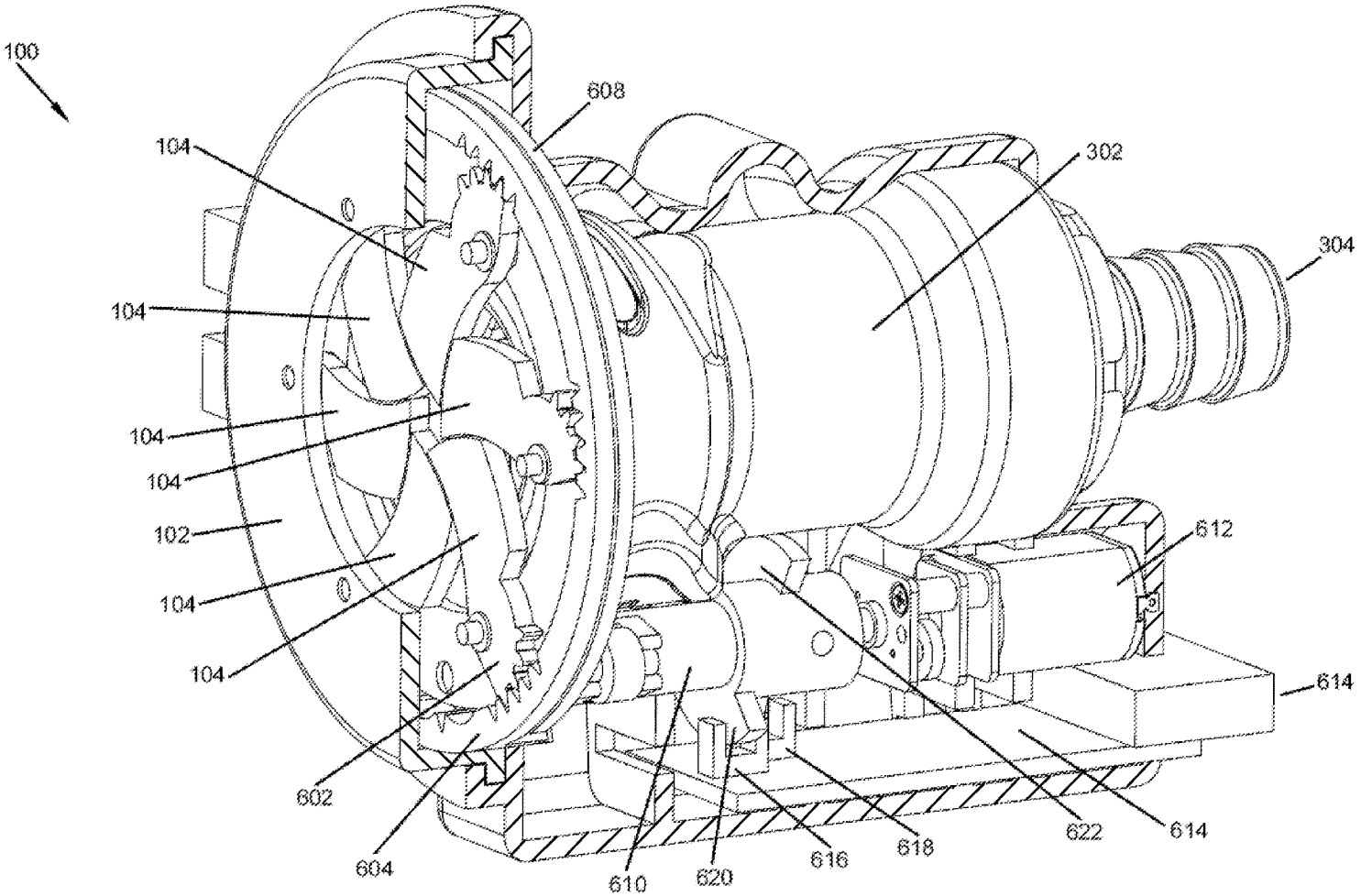
FIG. 6 is a perspective cut-away view of the lock-out coupler of FIG. 1 with the outer housing shown in phantom.

In the embodiment shown in FIG. 6, vane gear teeth 602 at one end of each of six vanes 104 are inserted into corresponding gear segments on ring gear 604. When ring gear 604 rotates, each of the vanes 104 also rotates. As stated earlier and discussed in more detail later herein, vanes 104 comprise a moveable iris. When the ring gear 604 and the vanes 104 rotate, the iris either opens or closes. The vanes 104 are shaped so that when the ring gear 604 and vanes 104 rotate in a clockwise direction, the vanes 104 spread apart, opening the lock-out coupler 100. When the ring gear rotates in a counterclockwise direction, the vanes 104 come together, closing the lock-out coupler 100.

When the cam shaft 610 rotates, the eccentric bearing 502 on the cam shaft 610 also rotates. As explained in detail later herein, when the eccentric bearing 502 rotates, the eccentric bearing 502 comes into contact with a latch plate of the coupler body 302, causing the coupler body 302 to open. When the coupler body 302 opens, the insert is released from the coupler body 302.

The position of cam shaft 610 is determined via optical interrupters 616, 618 and vanes 620, 622. Each optical interrupter 616, 618 includes an optical emitter on one side and an optical a receiver on the other side. Each of the two vanes 620, 622 is configured to fit inside one of the optical interrupters 616, 618 when the cam shaft 610 rotates. As shown in FIG. 6, vane 620 is configured to fit inside optical interrupter 616 and vane 622 is configured to fit inside optical interrupter 618.

When a vane 620, 622 is positioned inside an optical interrupter 616, 618, light emitted from the optical interrupter 616, 618 is blocked from being received at the receiver of the optical interrupter 616, 618. Therefore, each optical interrupter 616 has two logical states, referred to herein as a logical zero state and a logical one state. For an example logical one state, a vane is positioned inside the optical interrupter, blocking light from the emitter. For an example logical zero state, a vane is positioned outside the optical interrupter, permitting light from the emitter to be received at the receiver.

In an example implementation, because vane 622 is configured to be larger than vane 620 and because vanes 620 and 622 are offset from each other on cam shaft 610, four rotational areas of cam shaft 610 may be defined. Each rotational area may correspond to a logical state of the vanes 620, 622 and the optical interrupters 616, 618.

Rotational positions of cam shaft 610 may be defined by the logical states and by a transition from one rotational area to another. For example, an open position may be defined by a cam shaft 610 position whereby eccentric bearing 502 is pressing against the latch plate of coupler body 302, thereby opening the coupler body 302. Because the orientation of the eccentric bearing 502 in relation to vanes 620 and 622 is known, the open position corresponds to a specific logical state. Similarly, a closed position, defined by a cam shaft 610 position whereby eccentric bearing 502 is not pressing against the latch plate of coupler body 302, may be defined by a different specific logical state.

In an example implementation, gear motor 612 is a small permanent magnet direct current motor with a 1000:1 gear box. A resultant no-load shaft speed is about six RPM. Gear motor 612 is a 6-volt motor that is driven by a 5-volt motor driver, through the 1000:1 gear box. Gear motor 612 is directly connected to cam shaft 610.

Figure 6A:
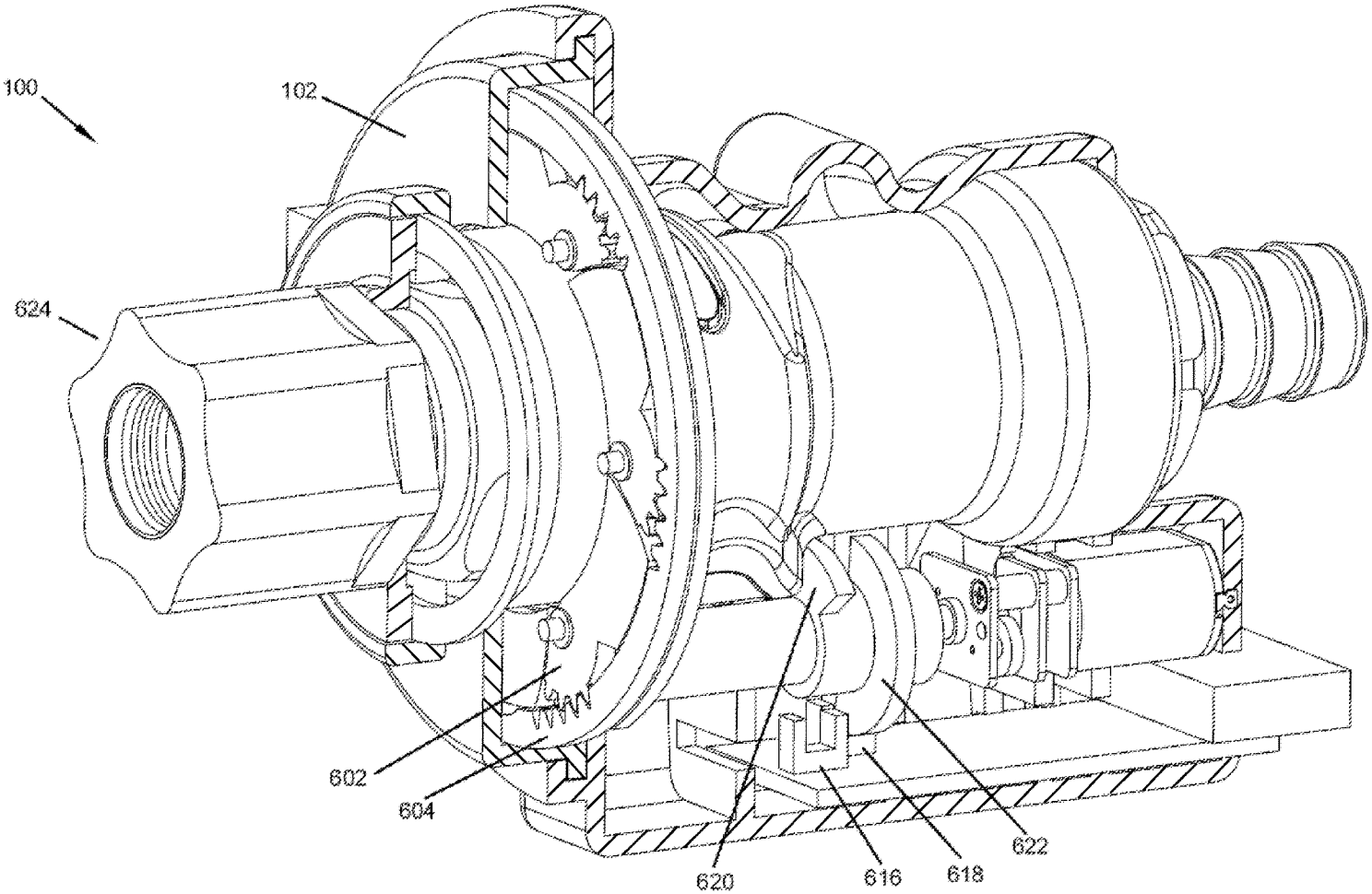
FIG. 6A is a perspective cut-away view of the lock-out coupler of FIG. 6 with an insert included.

FIG. 6A shows a cut-away of the lock-out coupler 100 with an insert 624 inserted. As shown in FIG. 6A, vanes 104 and ring gear 604 have rotated to open the iris and permit insert 624 to be inserted. Also, as shown in FIG. 6A vanes 620 and 622 have also rotated such that vane 622 is positioned inside optical interrupter 618 and vane 620 is positioned outside optical interrupter 616. Using the example logical state designations above, this orientation of vanes 620, 622 corresponds to a logical state of 1-0.

Figure 7:
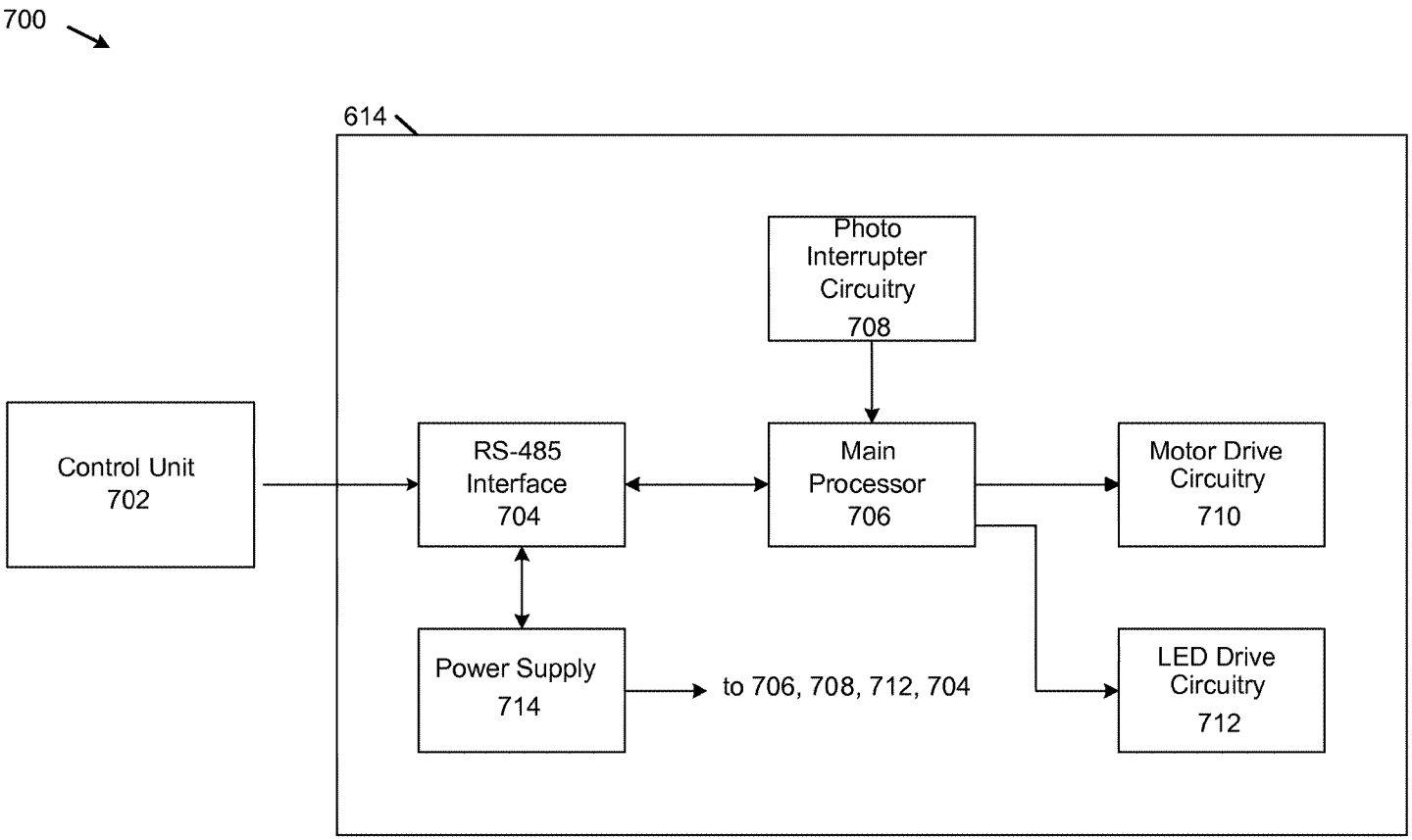
FIG. 7 is a block diagram of electrical components of the lock-out coupler of FIG. 6.

FIG. 7 shows an example control system 700 for the lock-out coupler 100. The control system 700 includes a control unit 702 and electronics board 614.

The control unit 702 is a user interface, for example a touch screen, which permits an operator to control the gear motor 612. By controlling the gear motor 612, the operator can cause the coupler body 302 to be in an open or closed position. For example, when an insert is inserted into the coupler body 302, the operator can issue a command to release the insert from the coupler body 302. For example, the operator may press an eject button on the control unit 702. This action may cause gear motor 612 to rotate cam shaft 610 such that eccentric bearing 502 presses against the latch plate of coupler body 302, causing coupler body 302 to open. The rotational position of cam shaft 610, as determined by the logical states, as discussed above, determines how long the cam shaft 610 rotates. Other operator commands are possible.

The electronics board 614 includes RS-485 interface 704, main processor 706, photo interrupter circuitry 708, motor drive circuitry 710, LED drive circuitry 712 and power supply 714.

RS-485 interface 704 provides a bidirectional interface between control unit 702 and main processor 706. RS-485 is an electrical standard for drivers and receivers that may be used for multi-drop communications. As discussed later herein, control unit 702 may control a plurality of lockout couplers using RS-485.

Main processor 706 is a microprocessor that includes instructions for operating various aspects of lock-out coupler 100. Operation aspects controlled by processor 706 include determining a rotational position of cam shaft 610, controlling operation of gear motor 612 and controlling operation of the LEDs on RFID antenna/LED board 608. Main processor 706 also receives instructions from control unit 702 to release an insert from lock-out coupler 100.

Photo interrupter circuitry 708 includes optical interrupters 616, 618 and circuitry that determines whether light emitted from an emitter of optical interrupters 616, 618 is received by a receiver of optical interrupters 616, 618. As discussed, when a vane 620, 622 is positioned inside one or optical interrupts 616, 618, light from an emitter of optical interrupters 616, 618 is blocked from being received at a receiver of optical interrupters 616, 618. A current status of optical interrupters 616, 618 is sent to main processor 708 so that a logical state of optical interrupters 616, 618 may be determined and a rotational position of cam shaft 610 may be identified.

Motor drive circuitry 710 includes a motor driver for controlling gear motor 612. The motor driver is a pulse width modulated full bridge driver with current limiting. The motor driver provides dynamic breaking for stopping gear motor 612 at an appropriate position.

LED drive circuitry 712 includes an LED driver for providing current to the LEDs on the RFID antenna/LED board 608. The LED driver is a constant current driver which drives one or two banks of four LEDs in parallel.

The power supply 714 provides electrical power, for example 3.3 volts, to components on electronics board 614. The components include RS-485 interface 704, main processor 706, photo interrupter circuitry 708 and LED drive circuitry 712.

Figure 7A:
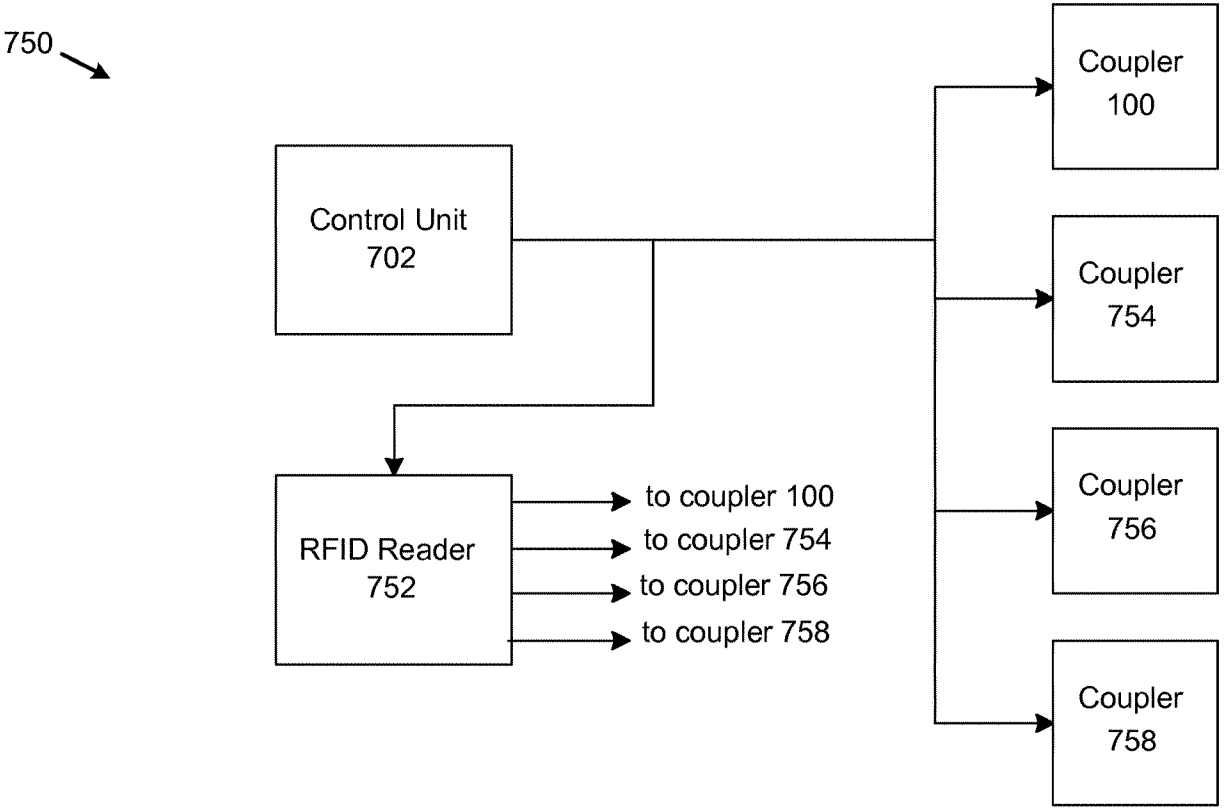
FIG. 7A is a block diagram of an example system with four lock-out couplers.

FIG. 7A shows an example system 750 in which one control unit 702 controls four lock-out couplers 100, 754, 756 and 758. An operator at control unit 702 can eject an insert from any of lock-out couplers 100, 754, 756 and 758 by pressing one of four buttons on control unit 702. Each button controls the ejection of an insert for a specific lockout coupler.

System 750 also shows an example in which one control unit 702 controls an RFID reader 752 for receiving RFID signals from up to four lockout couplers. An RFID antenna for each of lock-out couplers 100, 754, 756 and 758 is connected to one of four ports on RFID reader 752. As discussed, a particular insert is identified via an RFID tag on the insert. When an insert is in close vicinity to a lockout coupler, an identification signal is sent to RFID reader 752 from the RFID antenna in the lockout coupler.

Figure 8:
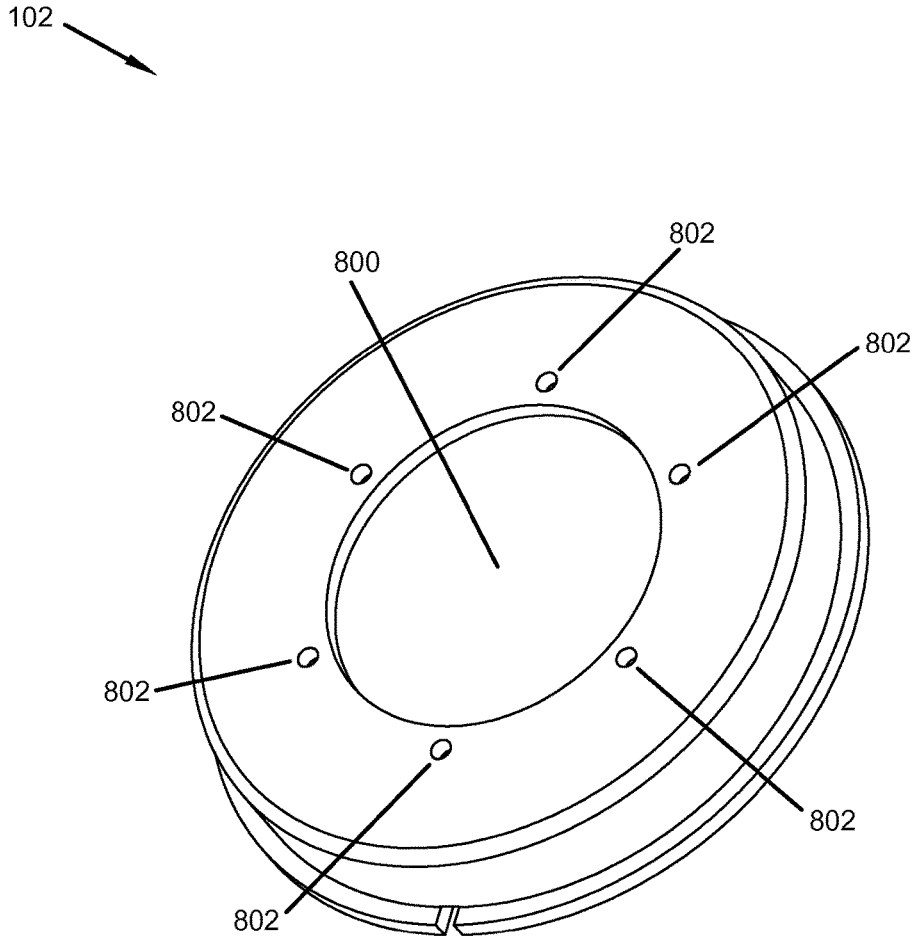
FIG. 8 is a perspective view of a front cover of the lock-out coupler of FIG. 1.
Figure 9A:
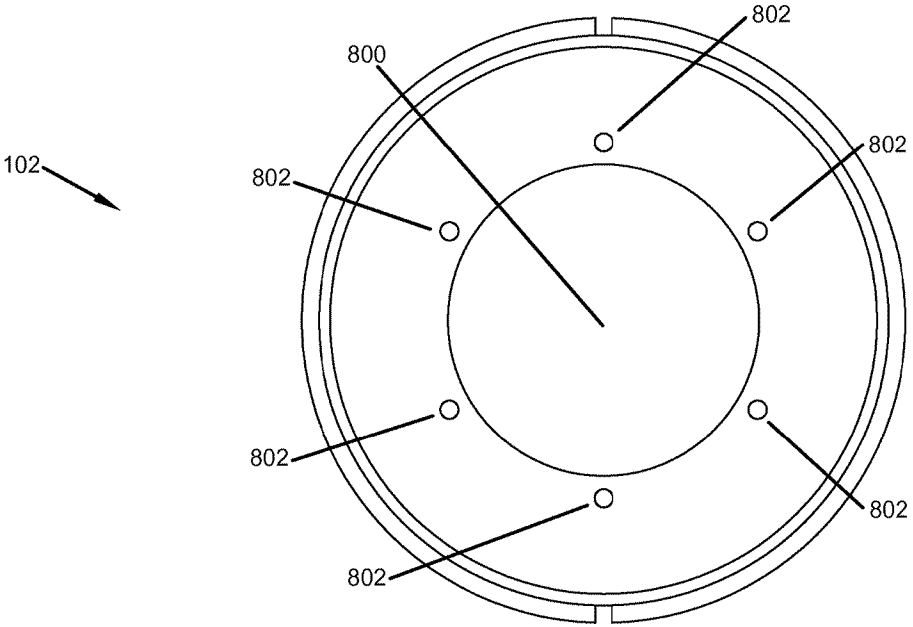
FIG. 9A is a top view of the front cover of FIG. 8.
Figure 9B:
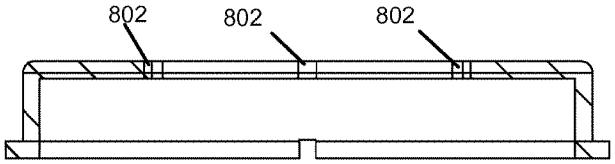
FIG. 9B is a cross-section view of the front cover of FIG. 8.

Referring now to FIGS. 8 and 9, an example front cover 102 of lock-out coupler 100 is shown. FIG. 8 shows a perspective view of front cover 102. FIG. 9A shows a top view of front cover 102. FIG. 9B shows a cross-section of a front view of front cover 102.

Front cover 102 includes a coupler-through-hole 800. The vanes 104 appears through the opening when lock-out coupler 100 is in a closed position. When lock-out coupler 100 is in an open position, vanes 104 spread apart to permit an insert to be inserted through the coupler-through-hole 800.

Front cover 102 also includes six vane pivot bearings 802 for securing each of the six vanes 104 to front cover 102. As discussed in more detail later herein, each of the vanes 104 includes a pivot shaft that fits inside one of six vane pivot bearings 802. As shown in FIG. 9B, a height of each pivot shaft (indicated by reference 802 in FIG. 9B) corresponds approximately to a thickness of the top of front cover 102.

Figure 10:
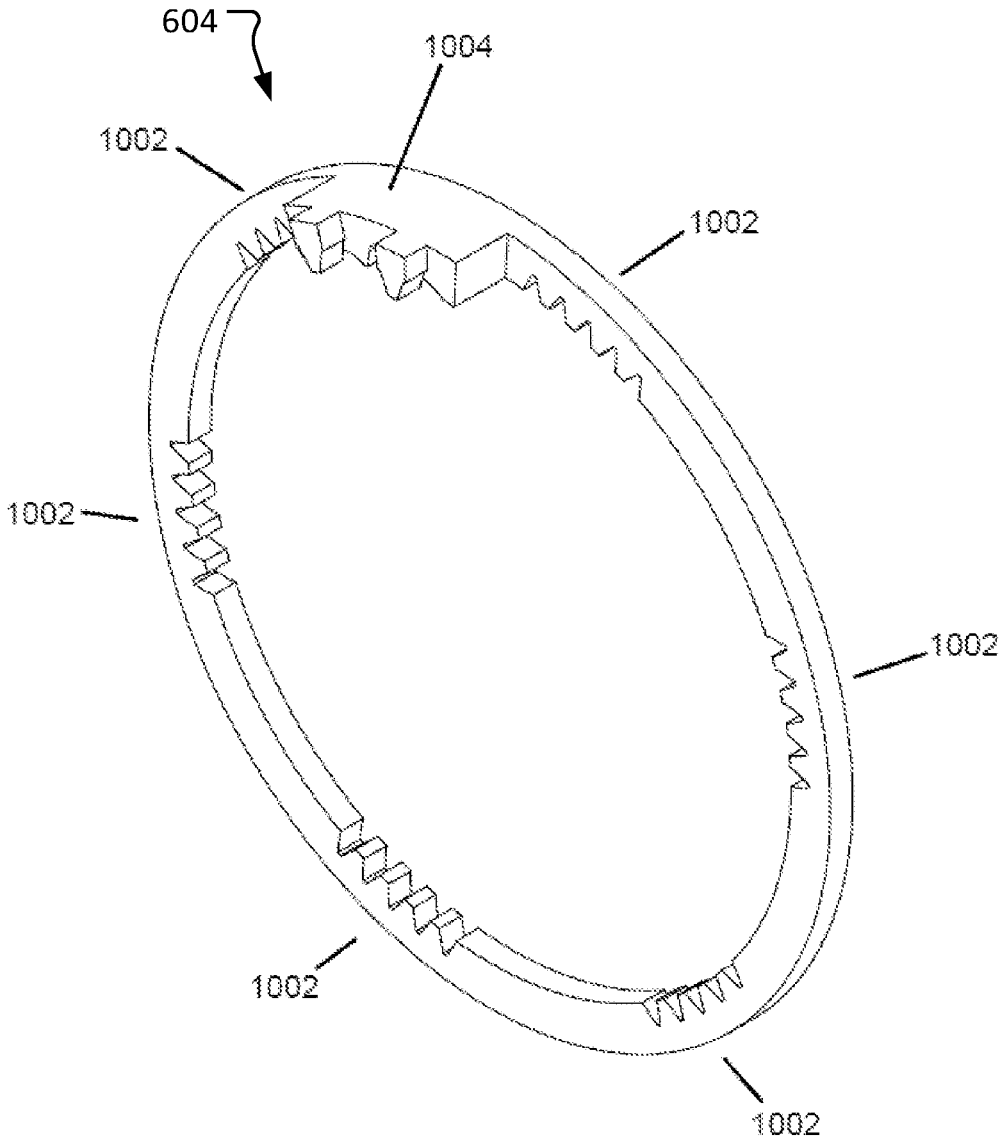
FIG. 10 is a perspective view of a ring gear of the lock-out coupler of FIG. 6.
Figure 11A:
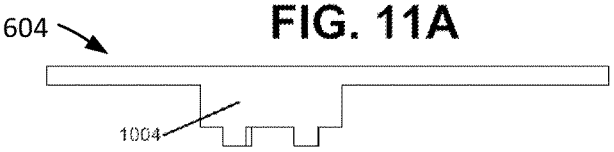
FIG. 11A is a top view of the ring gear of FIG. 10.
Figure 11B:
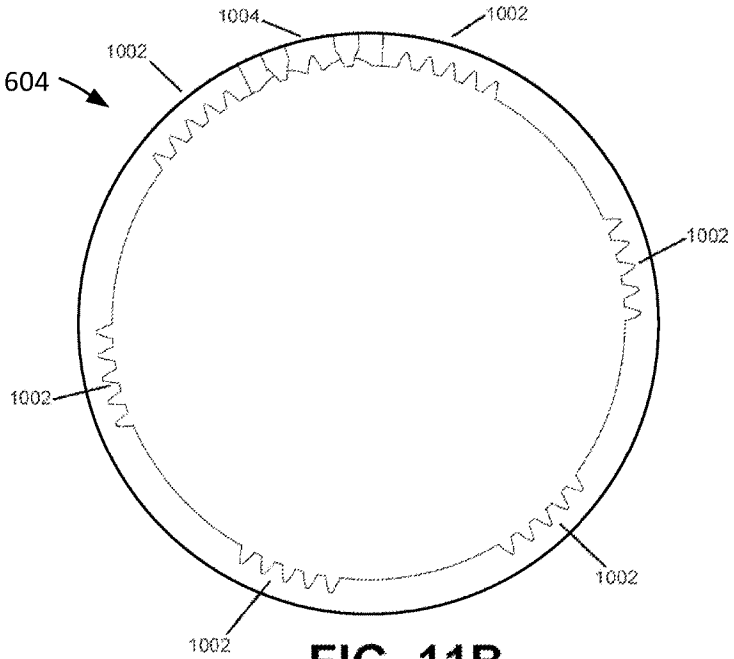
FIG. 11B is a front view of the ring gear of FIG. 10.
Figure 11C:
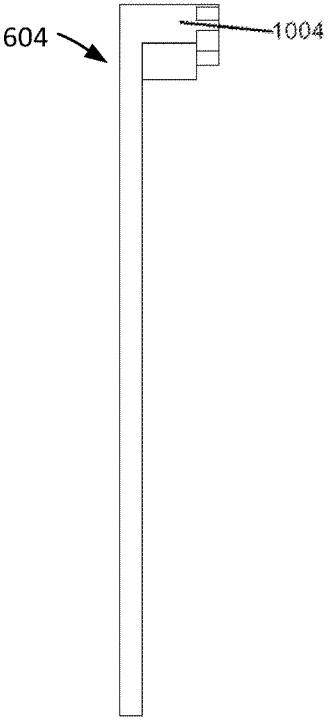
FIG. 11C is a side view of the ring gear of FIG. 10.

Referring now to FIGS. 10 and 11, an example ring gear 604 of lock-out coupler 100 is shown. FIG. 10 shows a perspective view of ring gear 604. FIGS. 11A, 11B and 11C show top, front and side views, respectively of ring gear 604.

Ring gear 604 fits between front cover 102 and RFID antenna/LED board 608. Ring gear 604 includes six gear vane engagement teeth segments 1002 for securing each of the six vanes 104 to ring gear 604. Gear teeth 602 on an end of each vane 104 fit into corresponding vane engagement teeth segment 1002 on ring gear 604.

In addition, ring gear 604 includes cam shaft engagement teeth 1004 for connecting to a spur gear on an end of cam shaft 610. As discussed in more detail later herein, when cam shaft 610 rotates, the spur gear on the end of cam shaft 610 cause ring gear 604 to rotate. As discussed previously, when ring gear 604 rotates, vanes 104 rotate, causing vanes 104 to either open or close, depending on the direction in which ring gear 604 rotates.

Figure 12:
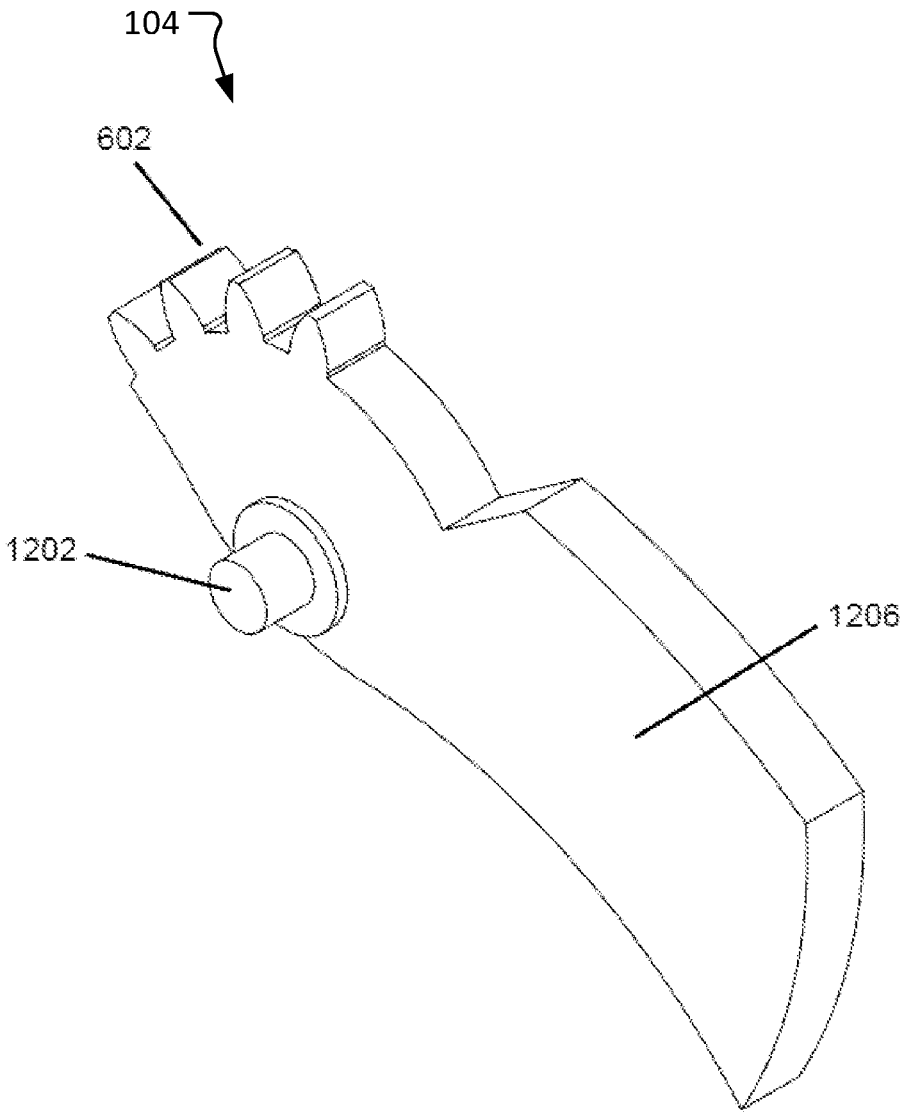
FIG. 12 is a perspective view of a vane of the lock-out coupler of FIG. 6.
Figure 13A:
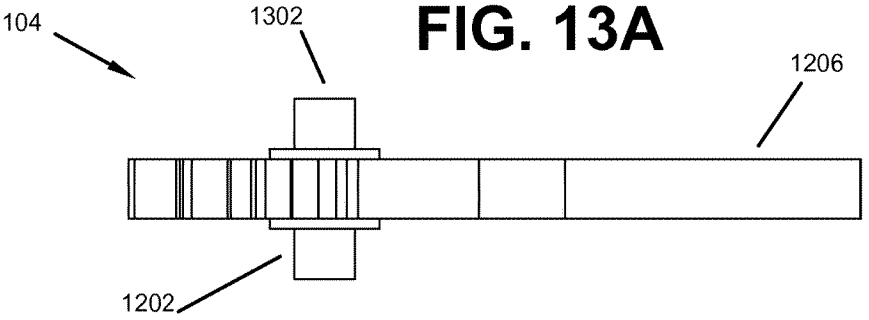
FIG. 13A is a top view of the vane of FIG. 12.
Figure 13B:
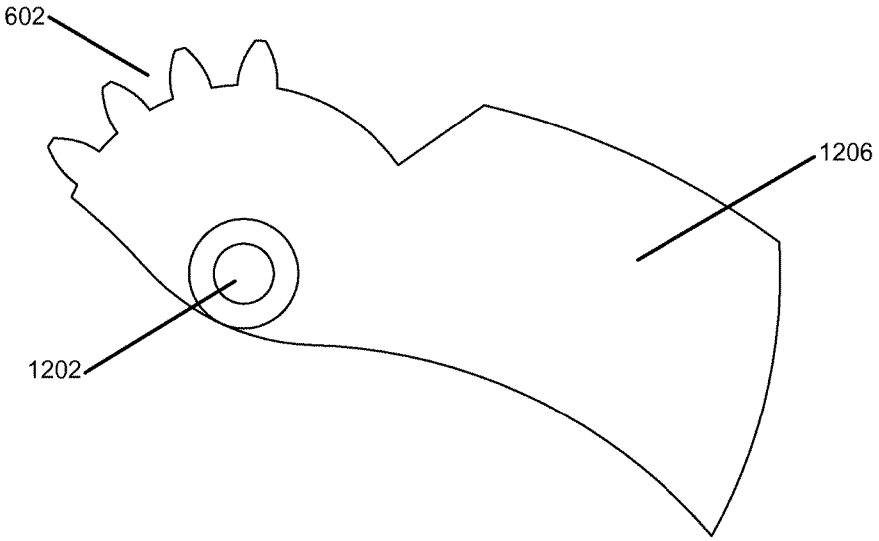
FIG. 13B is a front view of the vane of FIG. 12.
Figure 13C:
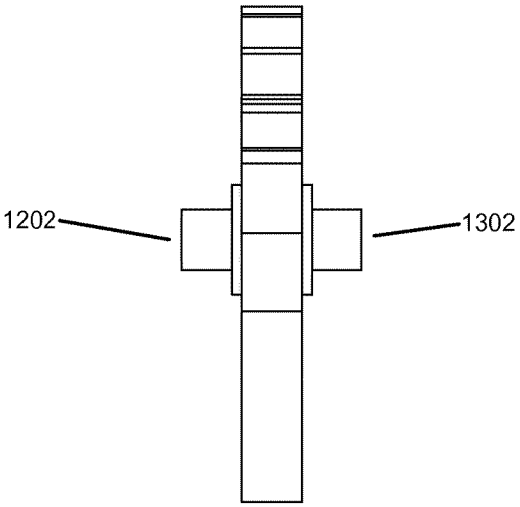
FIG. 13C is a side view of the vane of FIG. 12.

Referring now to FIGS. 12 and 13, an example vane 104 of lock-out coupler 100 is shown. FIG. 12 shows a perspective view of the vane 104. FIGS. 13A, 13B and 13C show top, front and side views, respectively of vane 104.

Each of the six vanes 104 includes gear teeth 602 and a vane blade 1206. In addition, each of the six vanes 104 includes a vane pivot shaft 1202 on one side of each vane 104 and a vane pivot shaft 1302 on a second side of each vane 104. As discussed earlier, the gear teeth 602 for each vane 104 fit into corresponding vane engagement teeth 1002 on ring gear 604. Also, as discussed earlier, each vane pivot shaft 1202 on the six vanes 104 fits into one of six vane pivot bearings 802 on front cover 102 to secure each vane 104 to the front cover 102 and to permit each vane 104 to pivot around a vane pivot bearing 802.

Figure 2:
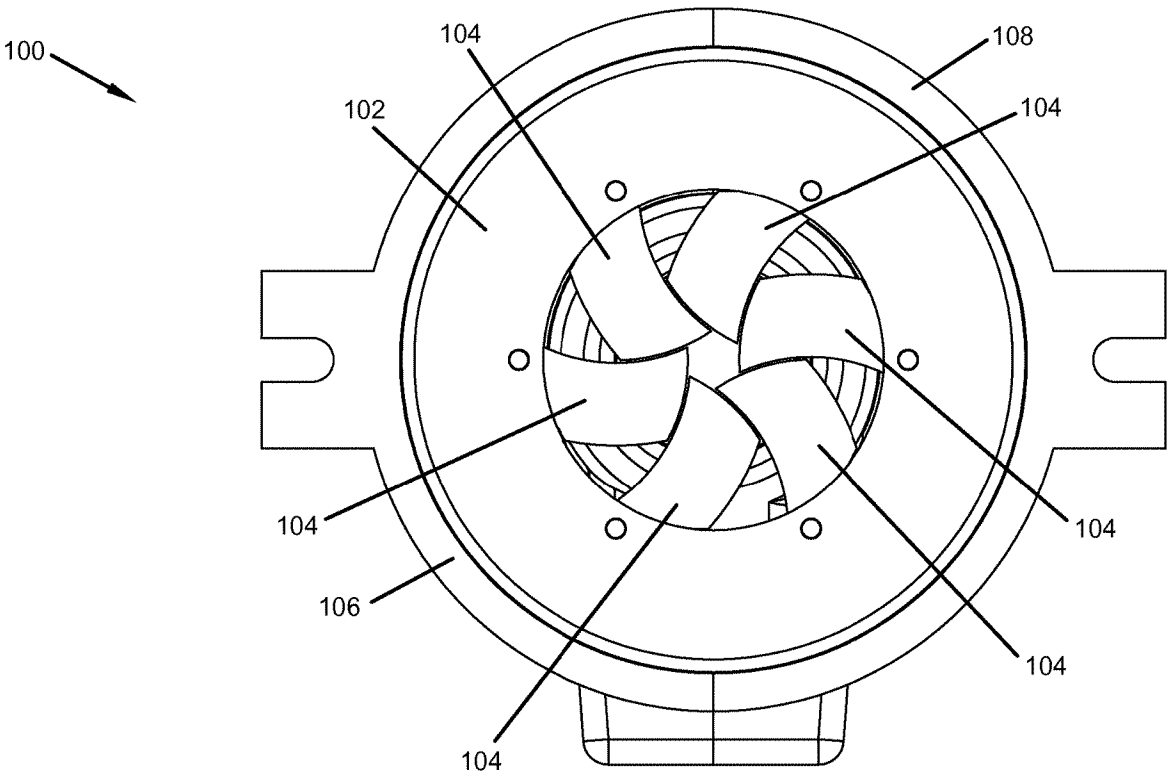
FIG. 2 is a front view of the lock-out coupler of FIG. 1.
Figure 3:
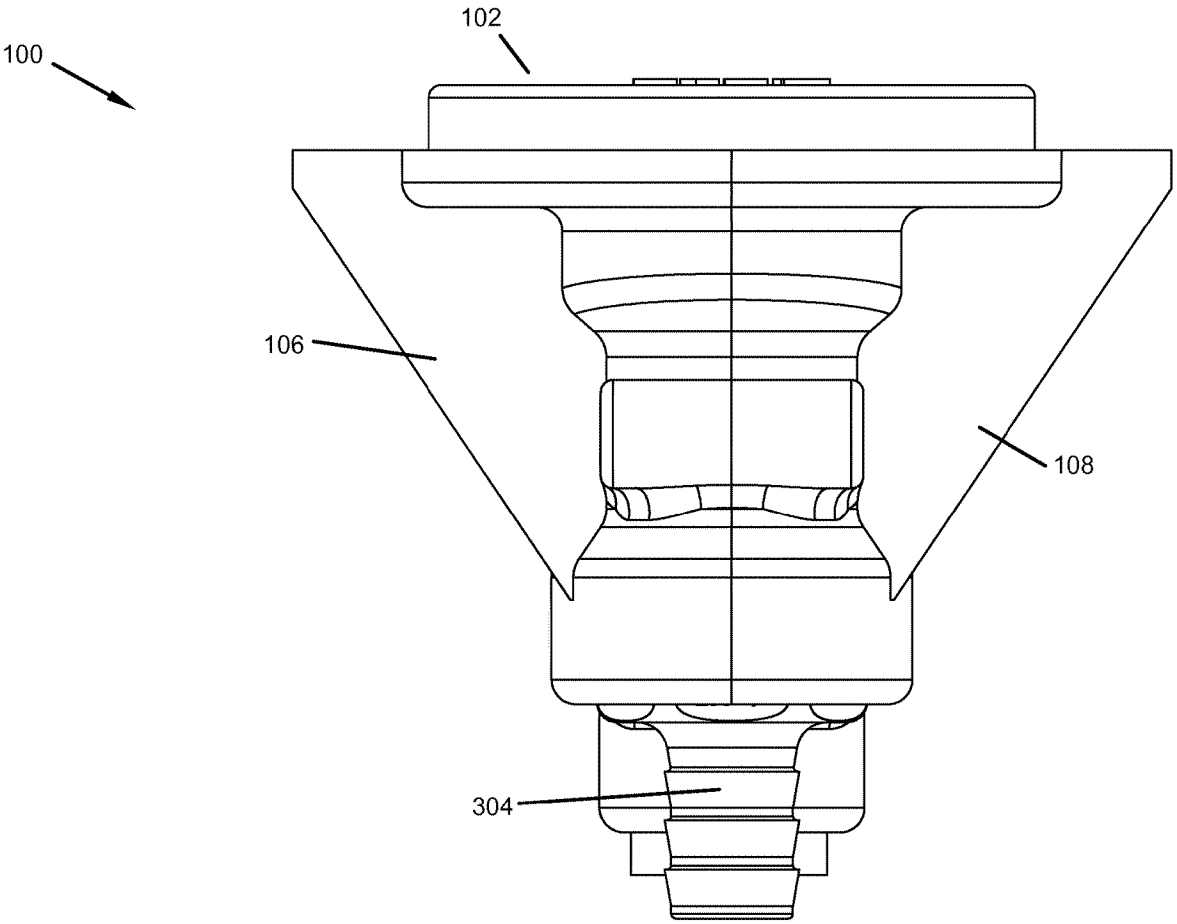
FIG. 3 is a top view of the lock-out coupler of FIG. 1.
Figure 4:
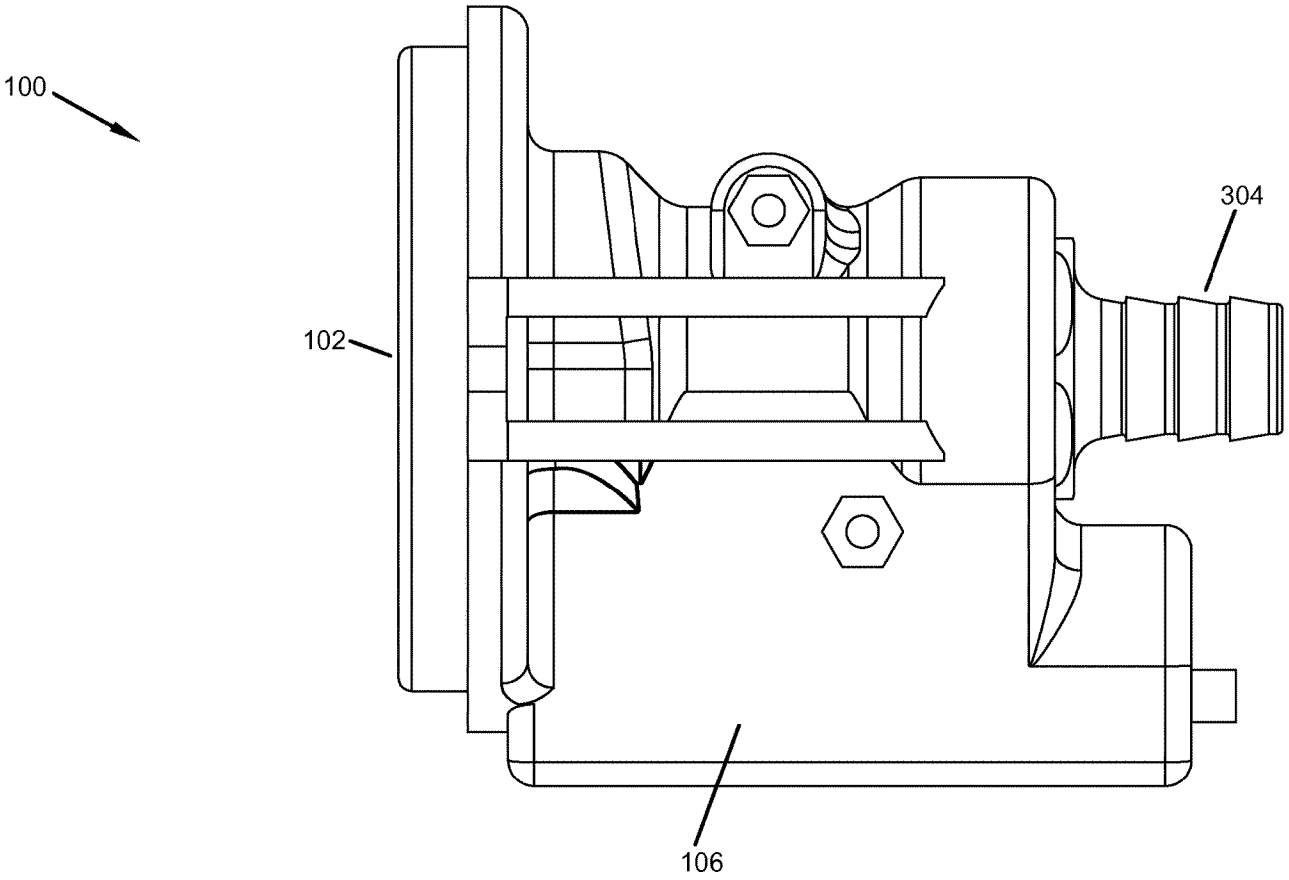
FIG. 4 is a side view of the lock-out coupler of FIG. 1.
Figure 5:
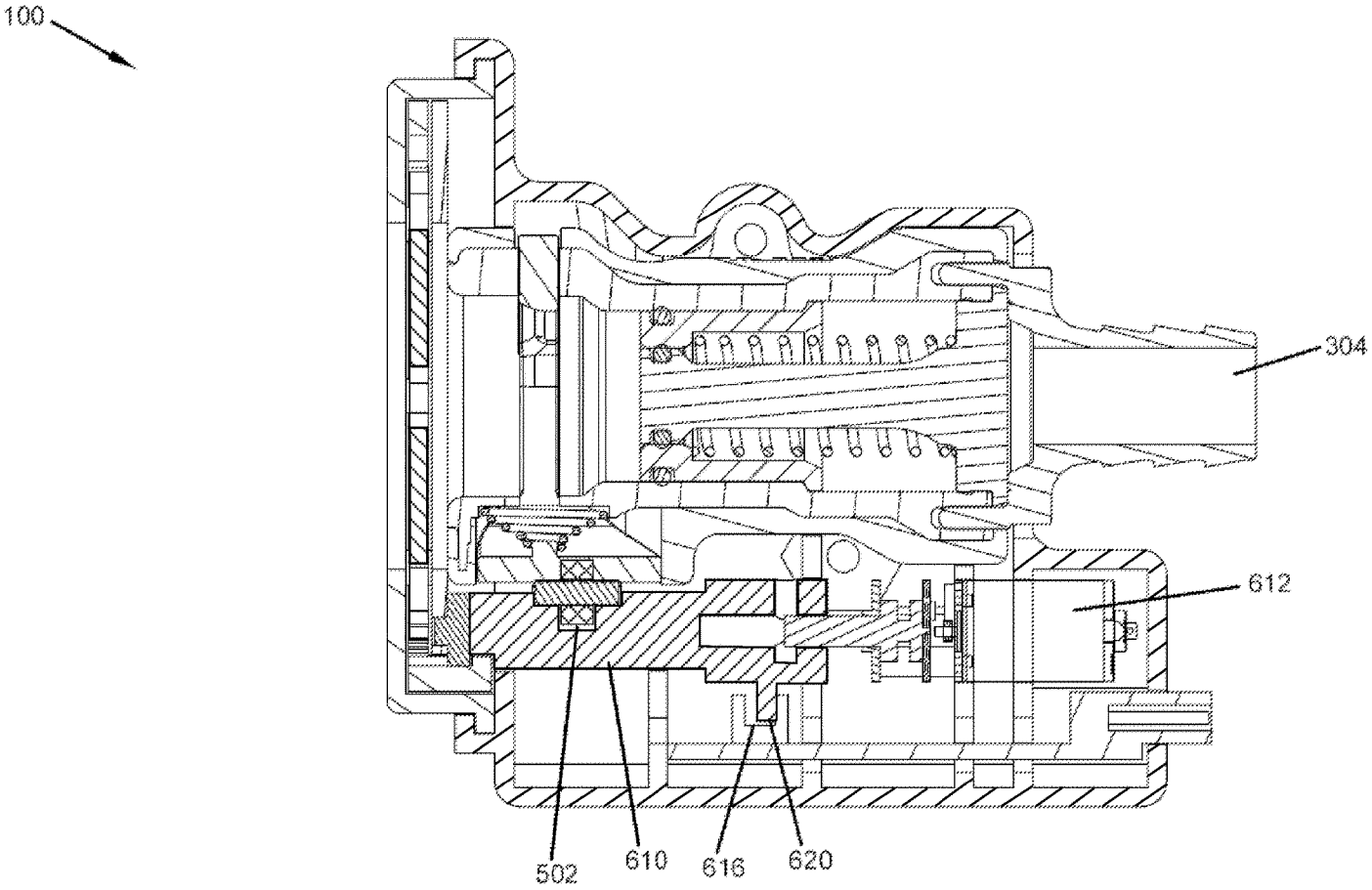
FIG. 5 is a cross-section drawing of the lock-out coupler of FIG. 1.

Also, as discussed earlier, each vane blade 1206 is not a separate part but is rather an area on an end of each vane 104. When lock-out coupler 100 is closed, each vane blade 1206 is visible from a view of lock-out coupler 100 via the front cover 102. A combination of six vane blades 1206 comprise the iris formed by moveable vanes 104, as shown in FIGS. 1 and 2.

Each vane pivot shaft 1302 on the second side of each vane 104 fits into one of six vane pivot bearings 1402 on RFID antenna/LED board 608. Thus, each vane 104 is secured between front cover 102 and RFID antenna/LED board 608.

Figure 14:
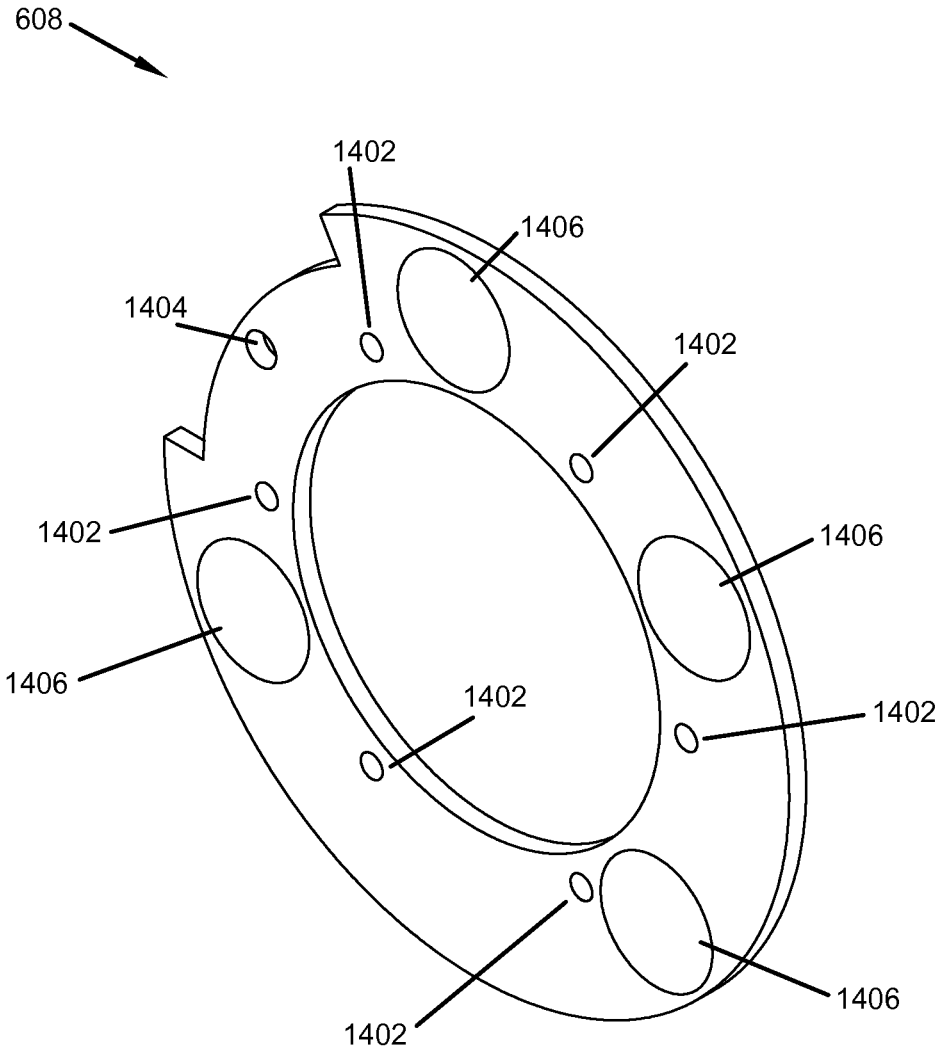
FIG. 14 is a perspective view of a radio frequency identification (RFID) assembly of FIG. 6.

Referring now to FIGS. 14 and 15, an example RFID antenna/LED board 608 of lock-out coupler 100 is shown. FIG. 14 shows a perspective view of the RFID antenna/LED board 608. FIGS. 15A, 15B and 15C show top, front and side views, respectively of RFID antenna/LED board 608.

The RFID antenna/LED board 608 comprises a printed circuit board that houses a circular RFID antenna (not shown in FIGS. 14 and 15). The RFID antenna connects electrically to an RFID reader. In some embodiments, the RFID reader may be located on the electronics board 614. In other embodiments, the RFID reader may be located external to lock-out coupler 100. The RFID reader, in conjunction with the RFID antenna, reads an RFID tag on an insert of an insert to be connected to coupler body 302.

The RFID antenna/LED board 608 also includes six vane pivot bearings 1402. Each of the six vane pivot bearings 1402 is a receptacle for one of the vane pivot shafts 1302 on one of the six vanes 104. The RFID antenna/LED board 608 also includes a cam shaft front bearing 1404. Cam shaft front bearing 1404 secures an end of cam shaft 610 to RFID antenna/LED board 608, as discussed later herein.

Figure 15A:
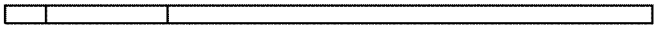
FIG. 15A is a top view of the RFID assembly of FIG. 14.
Figure 15B:
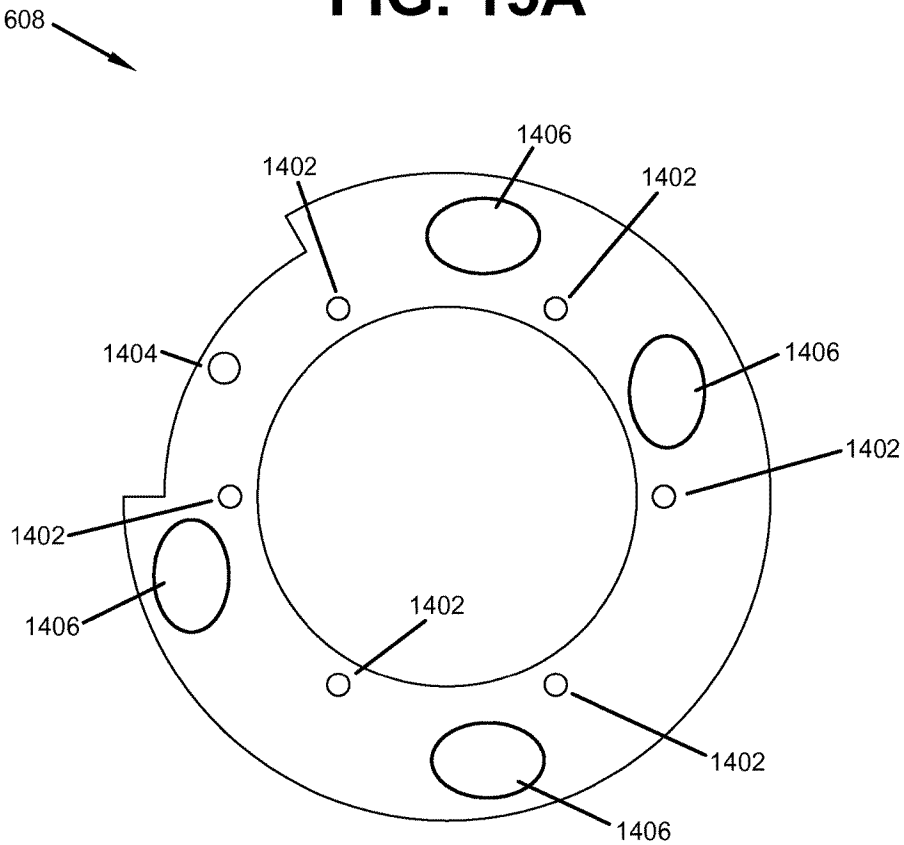
FIG. 15B is a front view of the RFID assembly of FIG. 14.
Figure 15C:
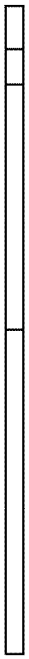
FIG. 15C is a side view of the RFID assembly of FIG. 14.
Figure 15D:
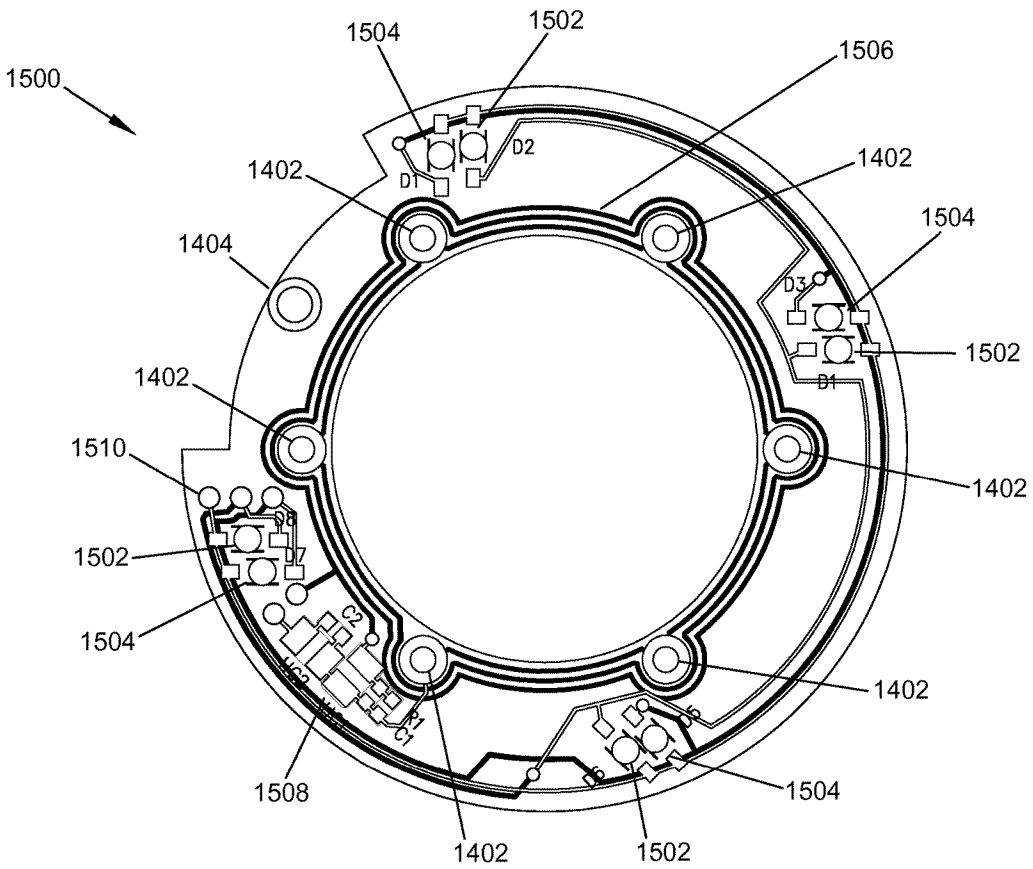
FIG. 15D is an electrical conductor trace pattern of example components of the RFID assembly of FIG. 14.

FIG. 15D shows an electrical conductor trace pattern of example components of RFID antenna/LED board assembly 608. As shown in FIG. 15D, RFID antenna/LED board 608 includes four red LEDs 1502 and four green LEDs 1504. Power for the LEDs is obtained from electronics board 614 via LED wire attachment points 1510 and electrically connected to the LEDs 1502 and 1504.

The RFID antenna/LED board assembly 608 also includes an RFID antenna 1506 and an antenna matching network 1508. An external RFID reader, for example RFID reader 752, is connected to RFID antenna 1506. The RFID antenna 1506 receives an RFID signal from an insert that is in close vicinity to lock-out coupler 100. The RFID signal from the insert includes identification information for the insert. The identification information is read by the external RFID reader to identify the insert.

Figure 16:
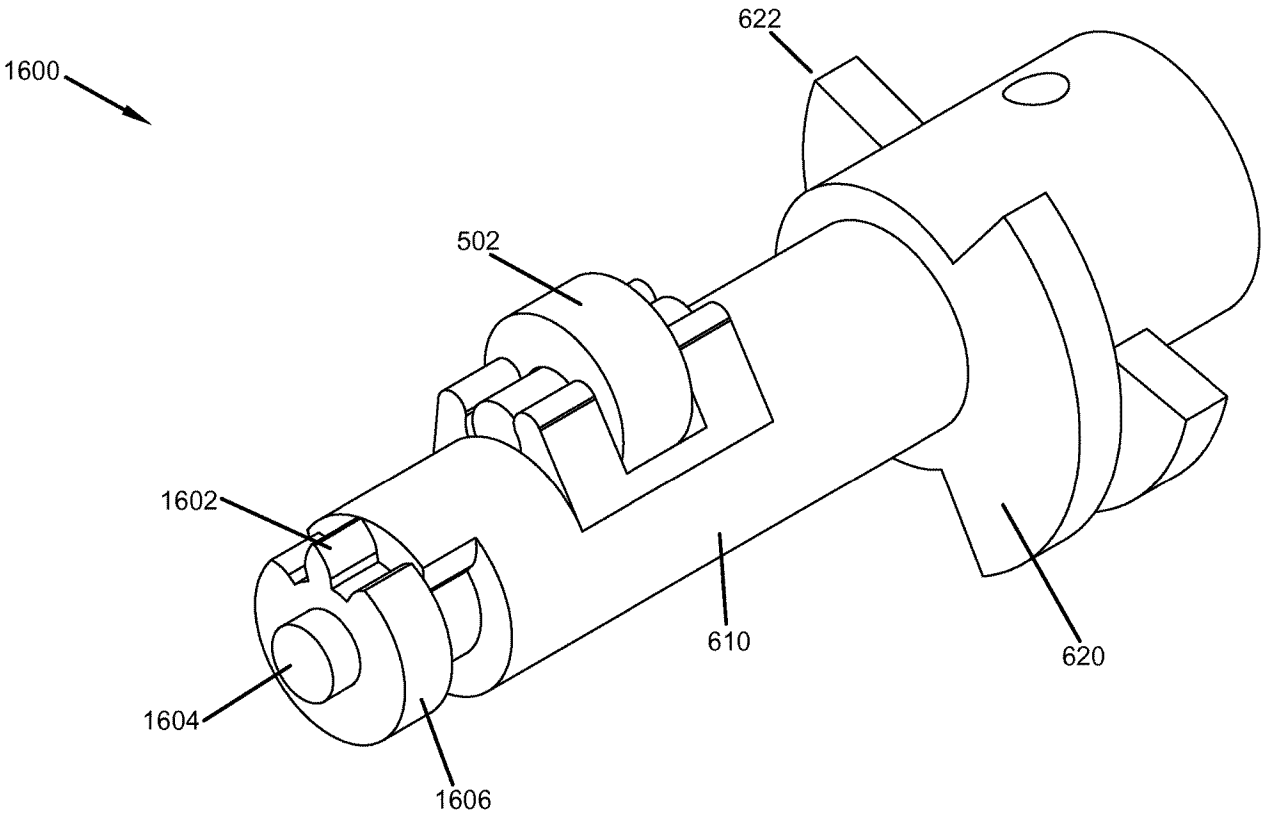
FIG. 16 is a perspective view of a cam shaft assembly of FIG. 6.

Referring now to FIGS. 16 and 17, a cam shaft 1600 of lock-out coupler 100 is shown. FIG. 16 shows a perspective view of the cam shaft 1600. FIGS. 17A, 17B and 17C show top, front and side views, respectively of cam shaft 1600.

The example cam shaft 1600 includes a cam shaft 610, an eccentric bearing 502, two vanes 620, 622, cam shaft spur gear 1602 and a cam shaft front support shaft 1604. The cam shaft front support shaft 1604 fits into cam shaft front bearing 1404 on the RFID antenna/LED board assembly 608 and secures the cam shaft 1600 in the RFID antenna/LED board 608.

As discussed earlier herein, when an insert of the correct type comes into close vicinity of the lock-out coupler 100, gear motor 612 causes cam shaft 610 to rotate. When cam shaft 610 rotates, cam shaft spur gear 1602 engages cam shaft engagement teeth 1004 on ring gear 604 and causes ring gear 604 to rotate. In the present implementation, when ring gear 604 rotates in a clockwise direction, vanes 104 open permitting the insert to be inserted through an opening in the front cover 102 of lock-out coupler 100 and come into contact with coupler body 302.

As cam shaft 610 continues to rotate in the clockwise direction, cam shaft spur gear 1602 disengages from cam shaft engagement teeth 1004. This permits cam shaft 610 to continue rotating without further rotating ring gear 604.

When cam shaft 610 rotates, the eccentric bearing 502 also rotates. When cam shaft 610 continues rotating in the clockwise direction, eccentric bearing 502 comes into contact with a latch plate on coupler body 302, pressing against the latch plate and permitting coupler body 302 to open. When coupler body 302 opens, the insert is released from coupler body 302.

After the insert has been released from coupler body 302, a command from control unit 702 causes gear motor 612 to reverse direction. As a result, cam shaft 610 rotates in a reverse direction. Cam shaft 610 rotates in the reverse direction until cam shaft spur gear 1602 engages cam shaft engagement teeth 1004 again, causing ring gear 604 to rotate in a counterclockwise direction and causing vanes 104 to close. In this example implementation, control unit 702 flashes the red LEDs several times to signify that vanes 104 are about to close. If at any time during the flashing of the red LEDs 1502, control unit 702 detects a new RFID tag, vanes 104 open, thus preventing vanes 104 from closing on a coupler.

Also as discussed earlier herein, as cam shaft 610 rotates, vanes 620 and 622 change positions in relation to optical interrupters 616 and 618. In this example implementation, vane 620 is at an orientation offset from vane 622. The orientation between vanes 620 and 622 generate four unique logical states as cam shaft 610 rotates. The four unique logical states provide feedback of the rotational position of cam shaft 610 as cam shaft 610 rotates and permits control unit 702 to issue commands to appropriately start, stop and reverse direction of cam shaft 610.

Figure 18:
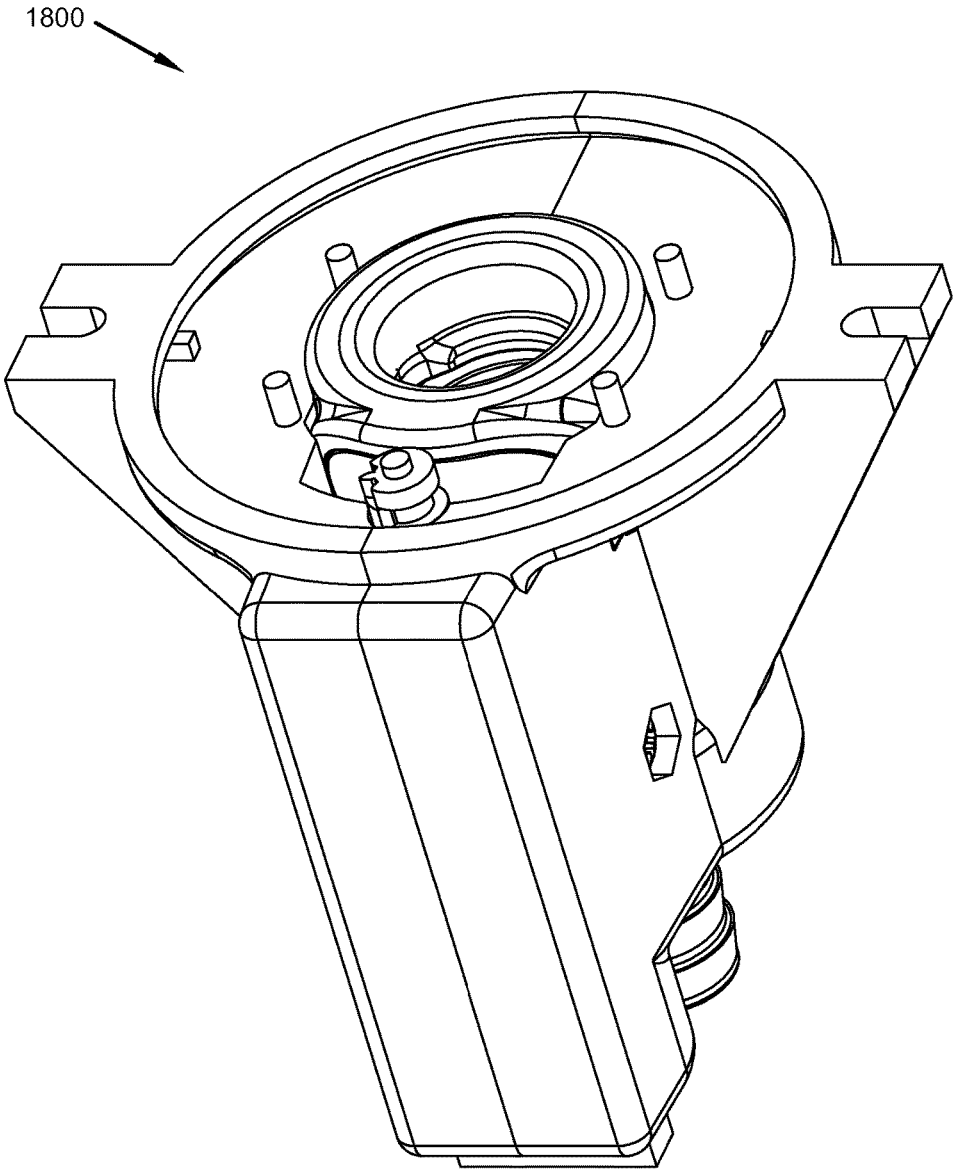
FIG. 18 is a perspective view of a motorized latch coupler of the lock-out coupler of FIG. 1.
Figure 19A:
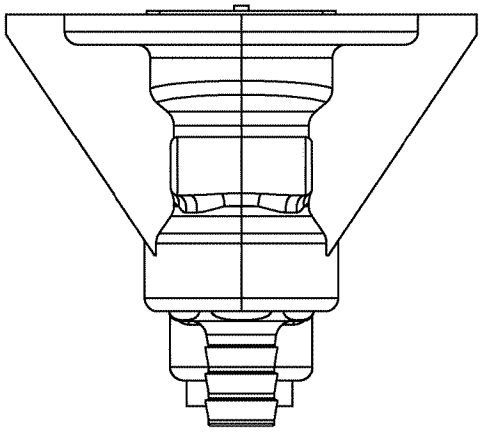
FIG. 19A is a top view of the motorized latch coupler of FIG. 18.
Figure 19B:
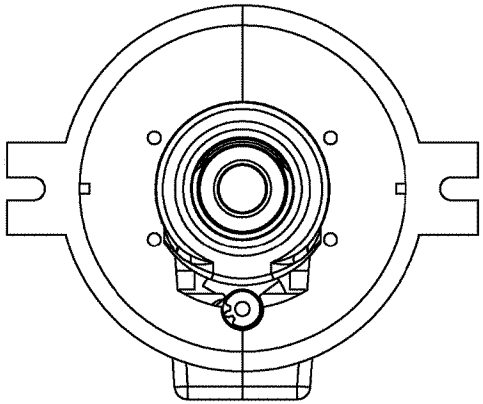
FIG. 19B is a front view of the motorized latch coupler of FIG. 18.
Figure 19C:
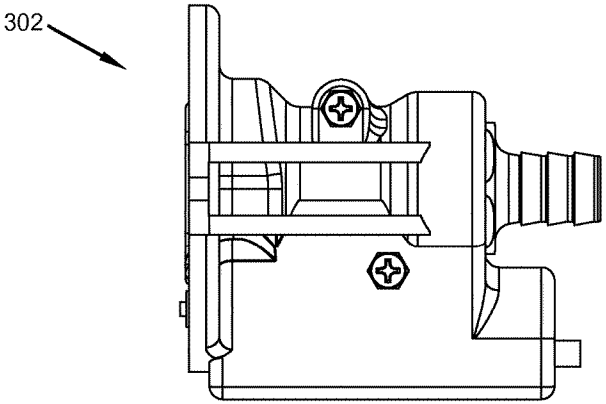
FIG. 19C is a side view of the motorized latch coupler of FIG. 18.
Figure 19D:
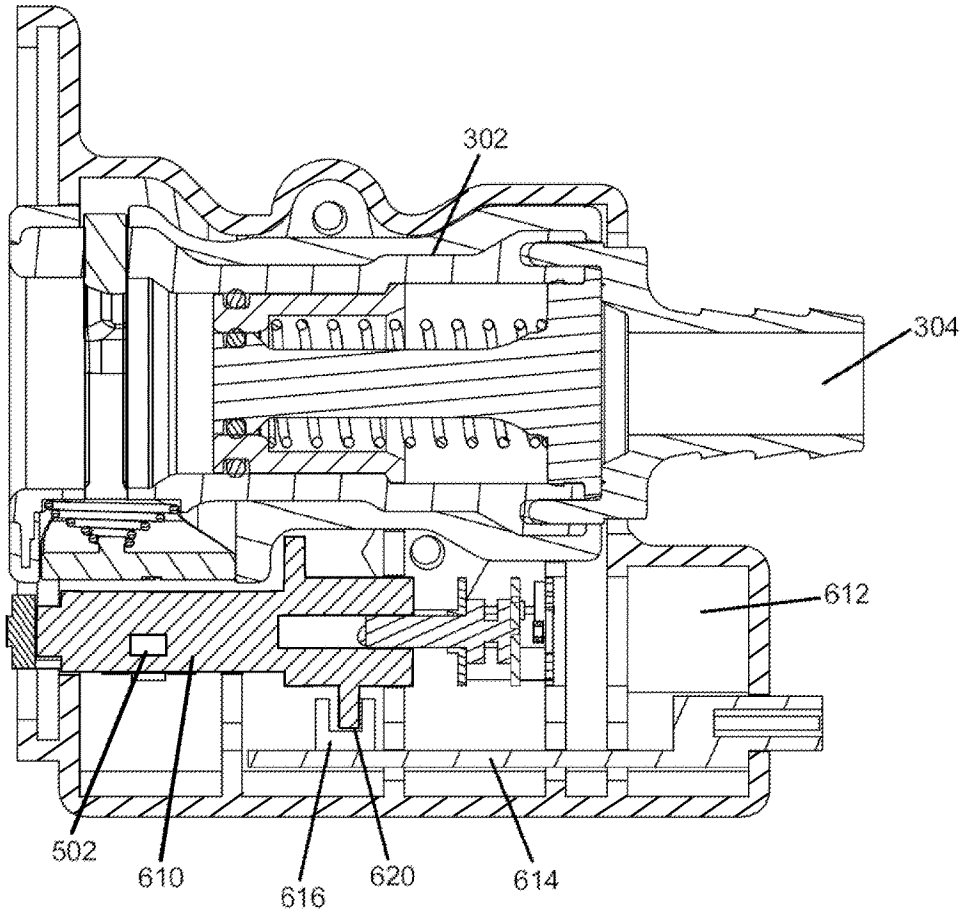
FIG. 19D is a cross-section view of the motorized latch coupler of FIG. 18.

Referring now to FIGS. 18 and 19, an example motorized latch coupler 1800 of lock-out coupler 100 is shown. FIG. 18 shows a perspective view of the motorized latch coupler 1800. FIGS. 19A, 19B, 19C and 19D show top, front, side and cross-section views, respectively of the motorized latch coupler 1800. The perspective view of the motorized latch coupler 1800 shown in FIG. 18 corresponds to a perspective view of lock-out coupler 100 without front cover 102, ring gear 604, vanes 104 and antenna/LED PC board 608.

The motorized latch coupler 1800 includes gear motor 612 and coupler body 302 in an enclosure. In an example implementation, also included in the enclosure are cam shaft 610, electronics board 614, optical interrupters 616, 618 and vanes 620, 622. The motorized latch coupler 1800 also includes a latch plate that may be used to open and close coupler body 302. The latch plate is a part of coupler body 302.

The coupler body 302 is normally spring-biased to a closed position. When the coupler body 302 is in the closed position, an insert may be physically inserted into the coupler body 302. The force of inserting the insert into the coupler is sufficient to temporarily move the latch plate to an open position, permitting the insert to be inserted into the coupler. When the insert is inserted into the coupler while in the closed position, the insert is locked in the coupler and prevented from being removed from the coupler. When the latch plate is set to an open position, the insert may be removed from the coupler body 302. As discussed earlier herein, the latch plate is controlled by rotation of the eccentric bearing 502.

Figure 20:
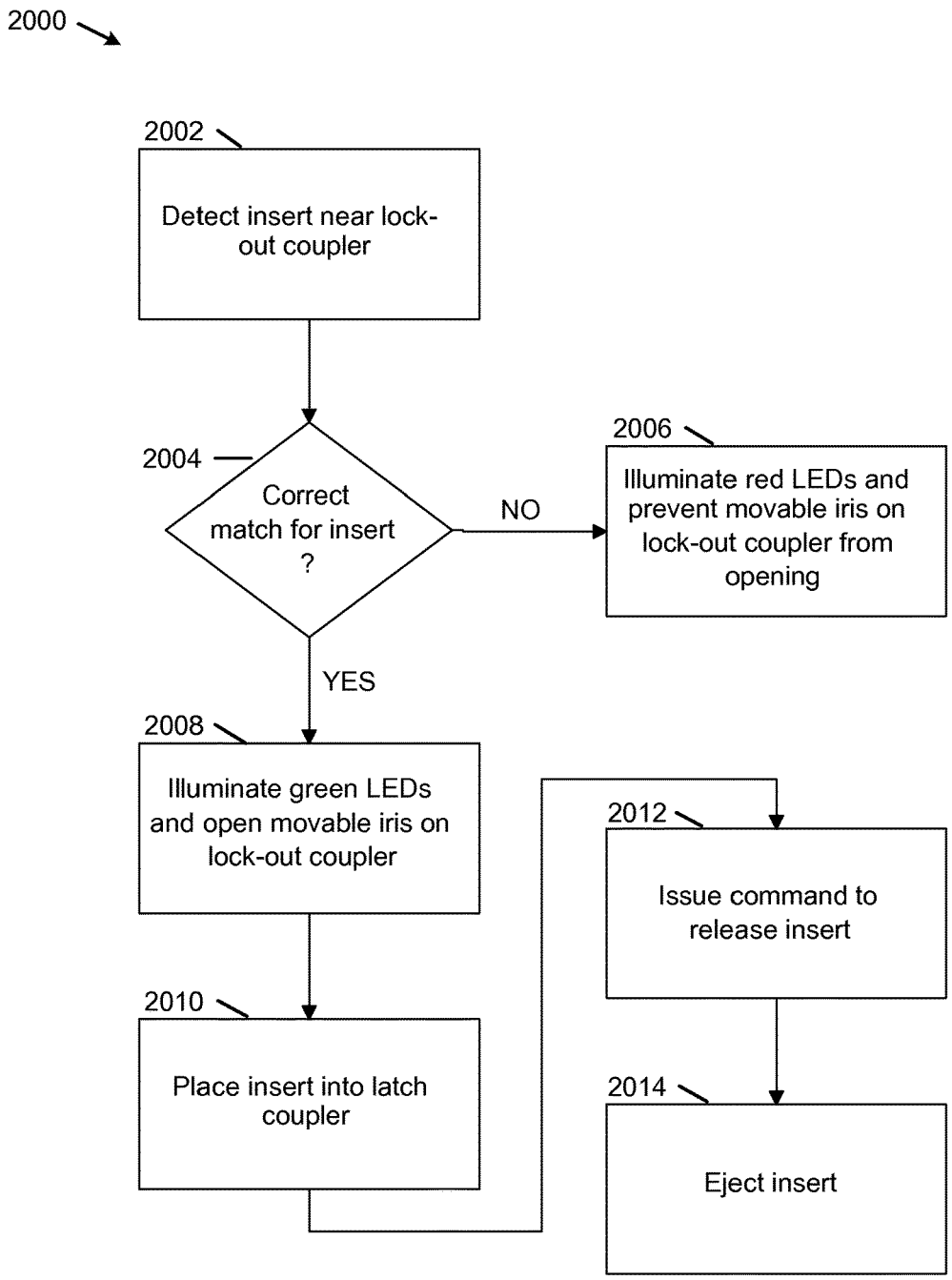
FIG. 20 is a flow chart for a method for using a lock-out coupler.

Referring now to FIG. 20, an example method 2000 used by controller unit 702 to control a lock-out coupler is shown. For the example method 2000, the lock-out coupler is lock-out coupler 100.

At operation, 2002, an insert is detected near the lock-out coupler 100. The insert is part of a component, such as a cartridge, having a material that is to be connected through the lock-out coupler 100 to a receiving device such as a printer. The insert includes an RFID tag. When the insert is moved close to the lock-out coupler 100, the RFID tag is detected and read by an RFID reader device. For the example operation 2002, the RFID reader device is external to the lock-out coupler 100. Instead, the lock-out coupler 100 includes an RFID antenna. The RFID antenna is connected electrically to the RFID reader device.

At operation 2004, a determination is made as to whether the component to which the insert is attached is a correct match for a receiving device that is connected to lock-out coupler 100. The determination is made by reading a serial number from the RFID tag, identifying the component from the serial number and determining whether the component is a correct match for the receiving device.

At operation 2004, when a determination is made that the component is not a correct match for the receiving device, at operation 2006 red LEDs 1502 illuminate on lock-out coupler 100. The illumination of the red LEDs 1502 provides a visual indication that the component is not a correct match for the receiving device. In addition, the vanes 104 on lock-out coupler 100 do not open. Keeping vanes 104 in a closed position prevents an operator from inadvertently connecting an incorrect insert to through lock-out coupler 100 to the receiving device.

At operation 2004, when a determination is made that the component is a correct match for the receiving device, at operation 2008 green LEDs illuminate on lock-out coupler 100. The illumination of the green LEDs 1504 provides a visual indication that the component is a correct match for the receiving device. In addition vanes 104 on lock-out coupler 100 open, permitting the insert of the component to be placed into lock-out coupler 100. The vanes 104 stop when the lock-out coupler 100 is in an open position.

At operation 2010, the insert is placed into coupler body 302 so that the component is connected to the receiving device. The insert engages and pushes a latch plate on coupler body 302 into an open position as it is inserted. The latch plate springs back when a latch groove on the insert is reached, thereby locking the insert into coupler body 302.

At operation 2012, a command is issued to release the insert from coupler body 302. The command is typically issued from a control device, for example from control unit 702 by for example selecting an eject button on the control device.

At operation 2014, gear motor 612 causes cam shaft 610 to rotate such that eccentric bearing 502 presses against the latch plate and ejects the insert. After the insert is ejected, control unit 702 commands the red LEDs 1502 flash on lock-out coupler 100, indicating that the movable iris is about to close.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

What is claimed is:

1. A motorized coupler assembly, comprising:

a coupler for coupling a mating coupling device to a receiving device;

a plurality of movable components that covers an opening of the coupler;

an electric motor; and an electronic sensing device, wherein, when the electronic sensing device detects that the mating coupling device is of a correct type, the movable components rotate to uncover the opening of the coupler and permit the mating coupling device to come into contact with the coupler.

2. The coupler assembly of claim 1, wherein the movable components are blade components, the blade components comprising a moveable iris.

3. The coupler assembly of claim 2, further comprising a ring gear attached to a shaft of the motor, each blade component including at one end gear teeth that are configured to be attached to a portion of the ring gear.

4. The coupler assembly of claim 1 further comprising:

an eccentric bearing attached to a shaft of the motor, the eccentric bearing being rotated when the shaft of the motor rotates; and a latch plate configured to lock the mating coupling device to the coupler.

5. The coupler assembly of claim 4, wherein when the eccentric bearing is rotated so that the eccentric bearing presses down upon the latch plate, the latch plate moves a sufficient distance to permit the mating coupling device to be disconnected from the coupler.

6. The coupler assembly of claim 1, wherein the electronic sensing device is a radio frequency identification (RFID) antenna.

7. The coupler assembly of claim 1, further comprising a plurality of optical sensing devices.

8. The coupler assembly of claim 7, wherein a shaft of the motor further comprises one or more vanes that are configured to be aligned with the optical sensing devices.

9. The coupler assembly of claim 8, wherein the vanes are oriented offset from each other.

10. The coupler assembly of claim 8, wherein a position of the one or more vanes with respect to the optical sensing devices determines a rotational position of the shaft of the motor.

11. The coupler assembly of claim 1, further comprising a plurality of light emitting diodes (LEDs), the plurality of LEDs including a plurality of red LEDs and a plurality of green LEDs.

12. The coupler assembly of claim 11, wherein the red LEDs are configured to illuminate when the electronic sensing device senses an incorrect type for the mating coupling device.

13. A method for connecting an insert of a component to a motorized coupler assembly, the method comprising:

detecting the insert at the motorized coupler assembly;

determining whether the insert is of a correct type for a coupler;

when a determination is made that the insert is the correct type for the coupler, moving a movable iris on the motorized coupler assembly into an open position to allow insertion of at least a portion of the insert into the motorized coupler assembly; and when a determination is made that the insert is not the correct type for the coupler, maintaining the movable iris in a closed position to prevent the insertion of the insert into the motorized coupler assembly.

14. The method of claim 13, wherein when the determination is made that the insert is the correct type for the coupler, further comprising opening a latch on the coupler, the opening of the latch permitting the insert to be inserted into the coupler.

15. The method of claim 13, wherein detecting the insert at the motorized coupler assembly comprises receiving a response from a radio frequency identification (RFID) tag on the insert.

16. The method of claim 15, wherein determining whether the insert is the correct type for the coupler comprises determining whether the RFID tag identifies the insert as being a match for the coupler.

17. The method of claim 13, wherein when a determination is made that the insert is not the correct type for the coupler further comprising illuminating a plurality of red light emitting diodes (LEDs) on the motorized coupler assembly.

18. The method of claim 13, wherein when the movable iris is in a closed position, the insert is prevented from being inserted into the coupler.

19. The method of claim 13, further comprising:

receiving a command to release the insert from the motorized coupler assembly;

after receiving the command, activating a motor in the motorized coupler assembly; and rotating an eccentric bearing attached to a shaft of the motor until the eccentric bearing presses against a latch plate of the coupler, the pressing of the eccentric bearing against the latch plate of the coupler causing the insert to be released from the motorized coupler assembly.

20. A motorized coupler assembly, comprising:

a coupler for coupling an insert to a receiving device;

a movable iris that covers an opening of the coupler, the movable iris comprising a plurality of blade components, each blade component including at one end gear teeth and at a second end a curved shape that may cover a portion of the opening of the coupler;

an electric motor;

a ring gear attached to a shaft of the motor, the ring gear including gear teeth receptacles for receiving the gear teeth from each of the blade components;

an eccentric bearing attached to the shaft of the motor, the eccentric bearing being rotated when the shaft of the motor rotates;

a plurality of optical sensing devices, each optical sensing device including an optical emitter and an optical receiver;

two vanes oriented offset from each other that are attached to the shaft of the motor; and a radio frequency identification (RFID) antenna, wherein, when the RFID sensing device senses an insert of a correct type, the shaft of the motor rotates to open the movable iris and permit the insert to come into contact with the coupler.

* * * * *